US008335462B2

(12) United States Patent
Watanabe et al.

(10) Patent No.: US 8,335,462 B2
(45) Date of Patent: Dec. 18, 2012

(54) IMAGE FORMING APPARATUS

(75) Inventors: Takeshi Watanabe, Osaka (JP); Keisuke Ohba, Osaka (JP)

(73) Assignee: Kyocera Mita Corporation (JP)

( * ) Notice: Subject to any disclaimer, the term of this patent is extended or adjusted under 35 U.S.C. 154(b) by 311 days.

(21) Appl. No.: 12/912,889

(22) Filed: Oct. 27, 2010

(65) Prior Publication Data

US 2011/0103850 A1 May 5, 2011

(30) Foreign Application Priority Data

Oct. 30, 2009 (JP) ..... 2009-250501
Oct. 30, 2009 (JP) ..... 2009-250502

(51) Int. Cl.
*G03G 15/14* (2006.01)

(52) U.S. Cl. ..... 399/315

(58) Field of Classification Search ..... 399/315, 399/398, 400
See application file for complete search history.

(56) References Cited

U.S. PATENT DOCUMENTS 7,457,573 B2 * 11/2008 Tsujita ..... 399/315
7,599,652 B2 * 10/2009 Takagami ..... 399/315

FOREIGN PATENT DOCUMENTS

JP 1-316774 12/1989
JP 4-338791 11/1992
JP 5-134565 5/1993
JP 11-95564 4/1999
JP 2002328552 A * 11/2002

* cited by examiner

*Primary Examiner* — David Gray
*Assistant Examiner* — Gregory H Curran
(74) *Attorney, Agent, or Firm* — Gerald E. Hespos; Michael J. Porco

(57) ABSTRACT

An image forming apparatus including: an image bearing member configured to bear the toner image; a transfer element configured to transfer the toner image to the sheet; a first application element configured to apply a transfer voltage to the transfer element; a separator configured to separate the sheet from the image bearing member, the separator including a separation electrode configured to discharge an electrical current and the separation electrode including first and second separation electrodes aligned along the transfer element; and a partition configured to project between the transfer element and the separator so as to allow a current to flow from the transfer element to the first separation electrode while the partition suppresses a current flowing from the transfer element to the second separation electrode.

7 Claims, 14 Drawing Sheets

IMAGE FORMING APPARATUS

BACKGROUND OF THE INVENTION

1. Field of the Invention

The present invention relates to an electrophotographic image forming apparatus.

2. Description of the Related Art

An electrophotographic image forming apparatus such as a copier, a printer or a facsimile machine typically includes a photoconductive drum used as an image bearing member. The image forming apparatus also includes a charger configured to apply a predetermined voltage to uniformly charge a circumferential surface of the photoconductive drum and an exposure device configured to irradiate the charged circumferential surface of the photoconductive drum with a laser beam. The irradiation of the laser beam from the exposure device partially causes optical attenuation in a potential on the circumferential surface of the photoconductive drum to form an electrostatic latent image in conformity with a document image on the photoconductive drum.

The image forming apparatus also includes a developing device configured to supply toner to the photoconductive drum on which the electrostatic latent image is formed. The toner from the developing device adheres to the circumferential surface of the photoconductive drum to develop the electrostatic latent image based on a relationship among parameters such as a surface potential of the electrostatic latent image, a charged amount of the toner itself and a bias voltage of the developing device.

The image forming apparatus further includes a transfer element such as a transfer roller near the photoconductive drum. A toner image resulting from the development of the electrostatic latent image is transferred to a sheet passing between the photoconductive drum and the transfer roller. The transfer element applies a bias voltage (transfer voltage) to electrostatically transfer the toner image from the photoconductive drum to the sheet.

The electrostatic transfer of the toner image from the photoconductive drum to the sheet causes the sheet itself to be charged. The charged sheet is likely to adhere to the circumferential surface of the photoconductive drum.

A typical image forming apparatus includes a separation electrode configured to electrically neutralize a sheet after transfer of a toner image. A separation voltage (bias voltage having a polarity opposite to that of a transfer voltage) applied to the separation electrode induces a discharge between the sheet and the separation electrode to reduce a charged amount of the sheet, so that the separation voltage facilitates to separate the sheet from the photoconductive drum.

The aforementioned image forming technology (technology for directly transferring a toner image from a photoconductive drum (image bearing member) to a sheet) is typically applied to image forming apparatuses configured to perform monochrome printing.

A tandem image forming apparatus configured to work for color printing typically performs a primary transfer process for transferring a toner image to an intermediate transfer member and a secondary transfer process for transferring the toner image from the intermediate transfer member to a sheet. The image forming apparatus includes a few aligned image forming portions. The image forming portions form different toner images in hue, respectively. Each of the image forming portions includes a photoconductive drum, on which a toner image is to be formed.

The image forming apparatus also includes transfer elements corresponding to the photoconductive drums of the image forming portions, respectively. In the primary transfer process, bias voltages are applied to the transfer elements. As a result, toner images on the photoconductive drums are successively transferred to the intermediate transfer member, respectively, and superimposed thereon.

The image forming apparatus also includes another transfer element configured to transfer the toner images from the intermediate transfer members to a sheet. In the secondary transfer process, a bias voltage (transfer voltage) is applied to this transfer element. As a result, the toner images superimposed on the intermediate transfer member are transferred to the sheet. The sheet charged due to the secondary transfer process is likely to adhere to the intermediate transfer member.

The typical image forming apparatus configured to perform color printing includes a separation electrode configured to electrically neutralize a sheet after transfer of a toner image thereto similarly to the above image forming apparatus configured to perform monochrome printing. A separation voltage (bias voltage having a polarity opposite to that of a transfer voltage) applied to the separation electrode induces a discharge between the sheet and the separation electrode to reduce a charged amount of the sheet, so that the separation voltage facilitates to separate the sheet from the intermediate transfer member.

Incomplete transfer (white dot phenomenon) in which a transferred toner image partially misses is known as a drawback of the aforementioned image forming apparatuses. As a result of the incomplete transfer of the toner image, a user sees dispersed small dot areas where a color of the sheet appears.

The incomplete transfer of a toner image is typically likely to occur when the toner image is transferred to a sheet with a larger resistance value under a low-temperature and low-humidity environment. Particularly, when a toner image is transferred to a second surface opposite to a first surface bearing a previously formed and fixed toner image, the incomplete transfer of the toner image is likely to occur.

A transfer voltage is generally applied to the transfer element configured to transfer a toner image to a sheet under a constant current control in which a constant current is generated. A larger absolute value of a transfer voltage needs to be applied to the transfer element immediately before or during passage of a sheet with a larger resistance value between an image bearing member and an transfer element. The application of the larger absolute value of the transfer voltage is likely to induce a discharge of the transfer element or the sheet. The discharge of the transfer element or the sheet produces non-charged toner or toner charged with an opposite polarity. The non-charged toner or toner charged with an opposite polarity is not transferred to the sheet, which results in the aforementioned incomplete transfer. The color of the sheet itself appears in tiny parts where the toner has not been transferred.

A photoconductive drum including amorphous silicon has a larger capacitance than organic photoconductors (OPCs). Thus, the photoconductive drum including amorphous silicon requires application of a larger absolute value of a transfer voltage. Therefore, incomplete transfer of a toner image is more likely to occur in the transfer of the toner image from the photoconductive drum including amorphous silicon.

The toner on the intermediate transfer member of the aforementioned tandem image forming apparatus is exposed to transfer voltages generated between the photoconductive drums and the transfer elements for the primary transfer a few times to be further charged. Accordingly, the toner on the intermediate transfer member requires application of a larger absolute value of a transfer voltage to the transfer element for the secondary transfer when being transferred to a sheet. Therefore, tandem image forming apparatuses are more likely to cause incomplete transfer of a toner image.

SUMMARY OF THE INVENTION

An object of the present invention is to provide an image forming apparatus which may be less likely to cause incomplete toner transfer.

One aspect of the present invention is directed to an image forming apparatus configured to form a toner image on a sheet, including an image bearing member configured to bear the toner image; a transfer element configured to transfer the toner image from the image bearing member to the sheet; a first application element configured to apply a transfer voltage to the transfer element in order to transfer the toner image from the image bearing member to the sheet; a separator configured to separate the sheet after transfer of the toner image thereon from the image bearing member, the separator including a separation electrode configured to discharge an electrical current to separate the sheet after the transfer of the toner image thereon from the image bearing member and the separation electrode including first and second separation electrodes aligned along the transfer element; and a partition configured to project between the transfer element and the separator so as to allow a current to flow from the transfer element to the first separation electrode while the partition suppresses a current flowing from the transfer element to the second separation electrode.

DETAILED DESCRIPTION OF THE PREFERRED EMBODIMENTS

Figure 1:
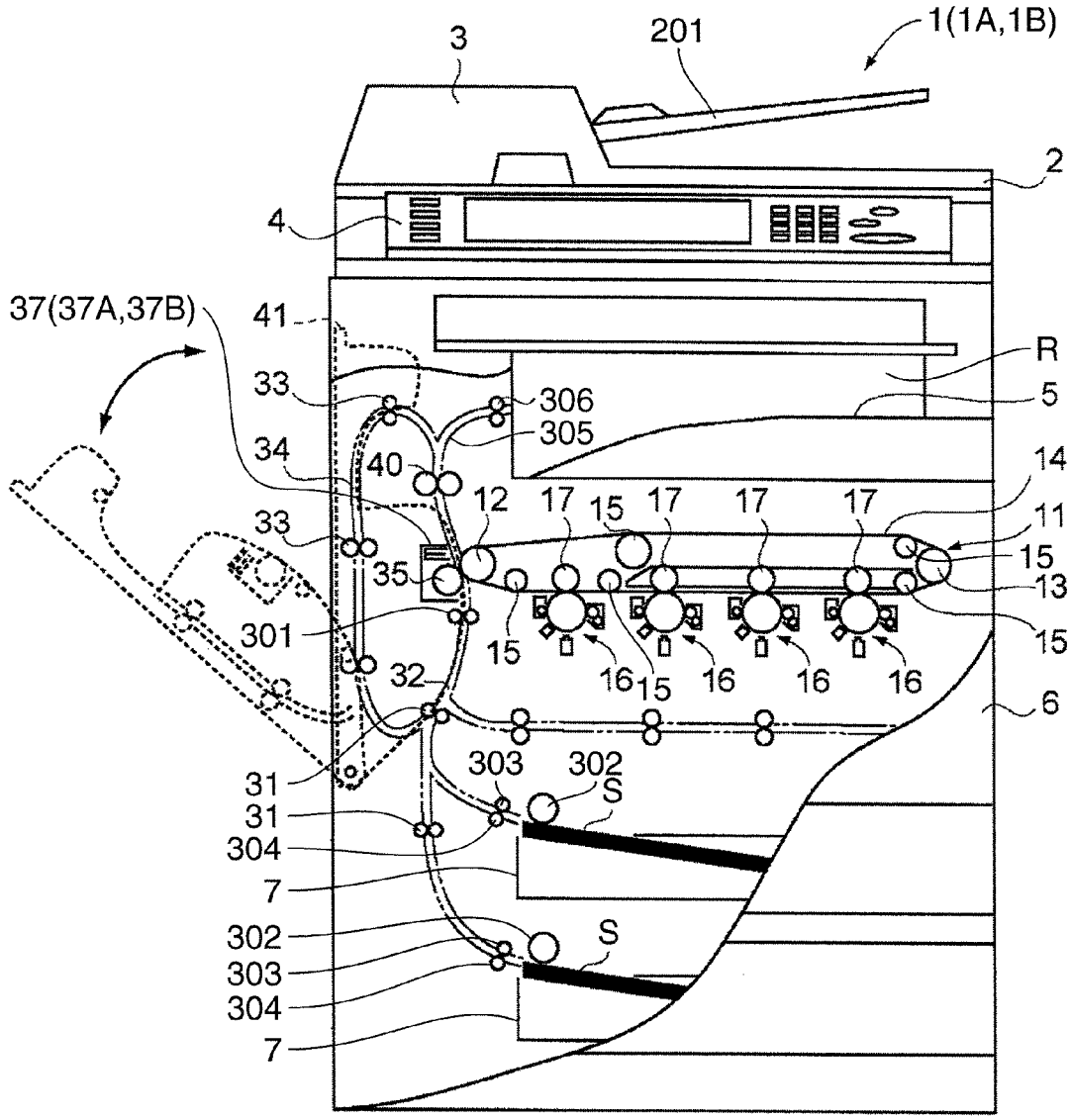
FIG. 1 is a schematic configuration diagram of a copier exemplified as an image forming apparatus according to a first embodiment.

Hereinafter, image forming apparatuses according to embodiments are described with reference to the accompanying drawings. Direction-indicating terms such as "upper", "lower", "left" and "right" are merely used in the following description for the purpose of clarifying the description and do not limit a scope of disclosed principles at all. Further, the following description and detailed structures in the drawings are for illustrating the image forming apparatuses without any intention to limit them.

FIRST EMBODIMENT

Configuration of Image Forming Apparatus

FIG. 1 is a schematic diagram showing an image forming apparatus according to a first embodiment. In the following description, an electrophotographical tandem copier configured to perform color printing is exemplified as the image forming apparatus. Alternatively, the image forming apparatus may be a monochrome copier, a printer or a facsimile machine which electrophotographically form an image. Alternatively, the image forming apparatus may be a multifunctional peripheral (complex machine) provided with functions of a copier, a printer and a facsimile machine.

A copier 1 includes a housing 6 and a pressing cover 2 rotatably mounted on the housing 6. The pressing cover 2 is vertically rotated between a pressing position where it lays on an upper surface of the housing 6 and an open position where it is distant from the upper surface of the housing 6.

The copier 1 further includes a placing glass (not shown) which partially forms the upper surface of the housing 6. A user may rotate the pressing cover 2 to the open position to place a document on the placing glass. Thereafter, the user may rotate the pressing cover 2 to the pressing position to press the document against the placing glass.

The copier 1 further includes a scanner (not shown) arranged below the placing glass. The scanner optically reads an image of a document on the placing glass.

The pressing cover 2 includes a placing tray 201, on which a document is to be placed, and a feeder 3 configured to feed the document on the placing tray 201 onto the placing glass. The user may place a stack of documents on the placing tray 201. The feeder 3 feeds a document one by one from the stack of the documents onto the placing glass.

The copier 1 further includes an operation panel 4. The user may operate the operation panel 4 to cause the copier 1 to perform a desired operation.

A horizontally extending hollow part R below the operation panel 4 is defined in the housing 6. A surface of the housing 6 defining a lower boundary of the hollow part R is used as a discharge tray 5. A sheet S subjected to a printing process is discharged onto the discharge tray 5.

The copier 1 further includes a printing mechanism accommodated in the housing 6. The printing mechanism prints a document image read by the aforementioned scanner on the sheet S. The printing mechanism is described below.

The printing mechanism includes an image forming unit 11, a secondary transfer roller 35, a separating unit 37 and a fixing device 40. The printing mechanism further includes sheet cassettes 7 configured to store sheets S. The sheet cassettes 7 are arranged in a bottom part of the housing 6.

The image forming unit 11 includes a drive roller 12, an idle roller 13 arranged at a distance from the drive roller 12 and an intermediate transfer belt 14 (endless belt) extending between the drive roller 12 and the idle roller 13. As the drive roller 12 rotates, the intermediate transfer belt 14 runs around the drive roller 12 and the idle roller 13. The idle roller 13 is rotated as the intermediate transfer belt 14 runs. The image forming unit 11 further includes a few supporting rollers 15. The supporting rollers 15 define a running path of the intermediate transfer belt 14 and/or hold the intermediate transfer belt 14 tense.

The drive roller 12 is about 30 mm in outer diameter. The drive roller 12 includes a metal shaft and a rubber layer (e.g. EPDM rubber: ethylene propylene rubber) covering a circumferential surface of the metal shaft.

The intermediate transfer belt 14 includes an outer surface configured to bear a toner image. The intermediate transfer belt 14 includes, for example, a base material made of PVDF (polyvinylidene fluoride) resin, an elastic layer (layer made of NBR (acrylonitrile rubber)) formed on the base material, and a coating layer (layer made of PTFE (polytetrafluoroethylene)) coating the elastic layer. In this embodiment, the intermediate transfer belt 14 is exemplified as an image bearing member.

The image forming unit 11 further includes image forming portions 16 configured to form images in accordance with a document image read by the aforementioned scanner and primary transfer rollers 17 configured to primarily transfer the images formed by the image forming portions 16 to the intermediate transfer belt 14.

In this embodiment, the four image forming portions 16 are arranged below the intermediate transfer belt 14. The four image forming portions 16 form, for example, magenta, cyan, yellow and black toner images, respectively. The toner images are transferred from the image forming portions 16 to the intermediate transfer belt 14 in the order of magenta, cyan, yellow and black. The magenta, cyan, yellow and black toner images are superimposed on the intermediate transfer belt 14 into one color toner image.

Figure 2:
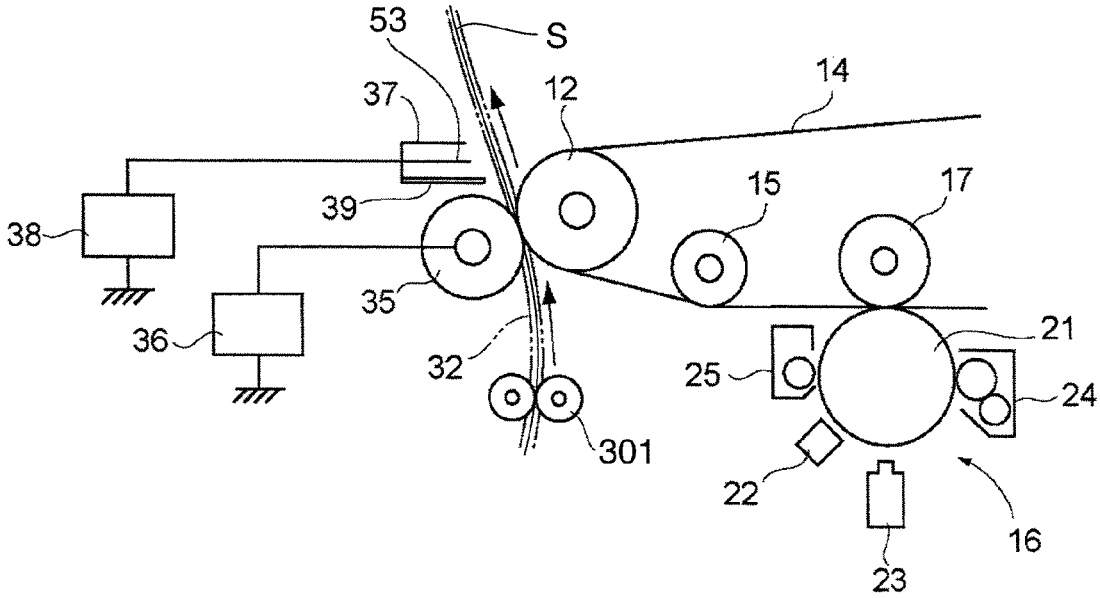
FIG. 2 is an enlarged view around a secondary transfer roller of the image forming apparatus shown in FIG. 1.

FIG. 2 shows a transfer structure for transferring a toner image. The image forming portion 16 is described with reference to FIGS. 1 and 2. It should be noted that the image forming portion 16 shown in FIG. 2 forms a black toner image. The structure of the image forming portion 16 described below is common to the image forming portion 16 for forming a magenta toner image, the image forming portion 16 for forming a cyan toner image and the image forming portion 16 for forming a yellow toner image.

The image forming portion 16 includes a photoconductive drum 21 adjacent to the outer surface of the intermediate transfer belt 14, a charger 22 configured to charge a circumferential surface of the photoconductive drum 21, an exposing device 23 configured to form an electrostatic latent image on the circumferential surface of the photoconductive drum 21, a developing device 24 configured to develop the electrostatic latent image on the circumferential surface of the photoconductive drum. 21 into a toner image, and a cleaner 25 configured to remove the toner remaining on the circumferential surface of the photoconductive drum 21 after the toner image on the circumferential surface of the photoconductive drum 21 is transferred onto the intermediate transfer belt 14.

The aforementioned primary transfer roller 17 is arranged above the photoconductive drum 21. The photoconductive drum 21 and the primary transfer roller 17 nip the intermediate transfer belt 14. The primary transfer roller 17 is about 20 mm in outer diameter, about 305 mm in length and about 6.5 log Ω in resistance value. The primary transfer roller 17 includes, for example, a metal shaft and an EPDM foam covering a circumferential surface of the metal shaft. The primary transfer rollers 17 corresponding to the four image forming portions 16 work to primarily transfer magenta, cyan, yellow and black toner images from the photoconductive drums 21 to the intermediate transfer belt 14, respectively.

As shown in FIG. 1, sheets S are stored in the sheet cassettes 7. In this embodiment, the sheets S are plain paper sheets. Alternatively, the sheets S may be postcards, tracing paper, OHP sheets or other sheet-like materials on which toner images are to be formed.

Two sheet cassettes 7 are shown in FIG. 1. The aforementioned printing mechanism includes pickup rollers 302 disposed above the two sheet cassettes 7, respectively. The pickup rollers 302 feed the sheets S from the sheet cassettes 7.

As shown in FIG. 1, the aforementioned secondary transfer roller is adjacent to the drive roller 12 configured to drive the intermediate transfer belt 14. The secondary transfer roller 35 and the drive roller 12 nip the intermediate transfer belt 14, so that a nip portion is formed between the secondary transfer roller 35 and the intermediate transfer belt 14. The secondary transfer roller 35 transfers the toner image from the intermediate transfer belt 14 to a sheet S. In this embodiment, the secondary transfer roller 35 is exemplified as a transfer element.

The secondary transfer roller 35 is about 22 mm in outer diameter and about 7 log Ω in resistance value. The secondary transfer roller includes a metal shaft and conductive epichlorohydrin foam surrounding a circumferential surface of the shaft. A length of the secondary transfer roller 35 is appropriately determined according to a width of the largest sheets S which the copier 1 may handle. If the copier 1 permits, for example, a maximum sheet width of 297 mm (A4 size), the length of the secondary transfer roller 35 is determined to be, for example, about 306 mm. In the following description, an expression "width of the sheet S" means a dimension of the sheet in a direction orthogonal to a conveying direction of the sheet S. An expression "width direction of the sheet S" means the direction orthogonal to the conveying direction of the sheet S. An expression "maximum sheet width" and similar expressions mean the width of the largest sheets S the copier 1 accepts.

A conveyance path 32 extending from the sheet cassettes 7 to the nip portion defined between the secondary transfer roller 35 and the intermediate transfer belt 14 is formed in the housing 6. The printing mechanism further includes feed rollers 303 and separating rollers 304 arranged immediately after the pickup rollers 302. The feed rollers 303 rotate so as to feed sheets S picked up by the pickup rollers 302 to the nip portion between the secondary transfer roller 35 and the intermediate transfer belt 14. The separating rollers 304 rotate so as to return sheets S picked up by the pickup rollers 302 to the sheet cassettes 7. As a result, if the pickup roller 302 substantially simultaneously picks up several sheets S from the sheet cassette 7, the separating roller 304 returns the extra sheet (s) S to the sheet cassette 7. In this way, the feed roller 303 feeds the sheets S one by one to the nip portion between the secondary transfer roller 35 and the intermediate transfer belt 14.

The printing mechanism further includes a conveyor roller unit 31 configured to assist conveyance of the sheet S fed to the conveyance path 32 by the feed roller 302. The conveyor roller unit 31 includes a pair of rollers.

The printing mechanism further includes a registration roller unit 301 arranged immediately before the nip portion between the secondary transfer roller 35 and the intermediate transfer belt 14. The registration roller unit 301 including a pair of rollers feeds the sheet S to the nip portion between the secondary transfer roller 35 and the intermediate transfer belt 14 in synchronism with a secondary transfer timing of the intermediate transfer belt 14. In this embodiment, the registration roller unit 301 is exemplified as a conveying element.

The registration roller unit 301 defines a conveying direction of the sheet S. Edge portions of the sheet S extending in the conveying direction of the sheet S are called "lateral edges" in the following description. An edge portion of the sheet S first passing the nip portion between the secondary transfer roller 35 and the intermediate transfer belt 14 is called a "leading edge". An edge portion of the sheet S passing the nip portion between the secondary transfer roller 35 and the intermediate transfer belt 14 last is called a "trailing edge". The lateral edges of the sheet S extend between the leading edge and the trailing edge.

While the sheet S passes the nip portion between the secondary transfer roller 35 and the intermediate transfer belt 14, a toner image is transferred to the sheet S from the intermediate transfer belt 14.

A discharge conveyance path 305 extending from the nip portion between the secondary transfer roller 35 and the intermediate transfer belt 14 to the aforementioned hollow part R is defined in the housing 6. The printing mechanism further includes a discharge roller unit 306 arranged at an end of the discharge conveyance path 305. The discharge roller unit 306 including a pair of rollers discharges the sheet S to the hollow part R after the printing process determined by operation of the aforementioned operation panel 4. Sheets S after the printing process are stacked on the aforementioned discharge tray 5.

The aforementioned fixing device 40 is arranged between the discharge roller unit 306 and the nip portion defined by the secondary transfer roller 35 and the intermediate transfer belt 14. The fixing device 40 fixes a toner image to a sheet S.

A branch conveyance path 34 branched off from the discharge conveyance path 305 immediately after the fixing device 40 is defined in the housing 6. When a user uses the operation panel 4 to instruct duplex printing, a sheet S after the fixing process by the fixing device 40 is guided to the branch conveyance path 34. Thereafter, the sheet S subjected to the duplex printing process is discharged to the hollow part R through the discharge conveyance path 305. When the user uses the operation panel 4 to instruct simplex printing, a sheet S is guided toward the discharge roller unit 306 and then discharged to the hollow part R.

The printing mechanism further includes a few conveyor roller units 33 arranged along the branch conveyance path 34. The conveyor roller units 33 include a pair of rollers, respectively. The conveyor roller units 33 assist conveyance of a sheet S passing the branch conveyance path 34.

The printing mechanism further includes a vertically rotatable side unit 41 mounted in the housing 6. An inner surface of the side unit 41 partially defines the branch conveyance path 34. Some conveyor roller units 33, the secondary transfer roller 35 and the separating unit 37 to be described later are mounted in the side unit 41. A user may pull out the side unit 41 sideways to open the branch conveyance path 34 in order to remove a sheet S jammed in the branch conveyance path 34 and perform other maintenance operations.

(Separator)

As shown in FIG. 2, the aforementioned printing mechanism further includes a first application circuit 36 electrically connected to the secondary transfer roller 35. The first application circuit 36 configured to execute a constant current control applies a transfer voltage (bias voltage) to the secondary transfer roller 35. As a result, a toner image on the intermediate transfer belt 14 is secondarily transferred to a sheet S. The first application circuit 36 may be mounted on a rear wall (wall opposite to a front wall on which the operation panel 4 is mounted) of the aforementioned housing 6. In this embodiment, the first application circuit 36 is exemplified as a first application element.

As described above, the secondary transfer roller 35 is longer than a width of a sheet S. A nip area (longitudinal area of the secondary transfer roller 35 (i.e. width direction of the sheet S)) corresponding to the width of the sheet S passing the nip portion between the secondary transfer roller 35 and the intermediate transfer belt 14 is called a "passage area" in the following description.

A transfer current (applied current) produced by the aforementioned constant current control of the first application circuit 36 is set at a suitable value for the secondary transfer. When the transfer voltage is applied to the secondary transfer roller 35 under the constant current control of the first application circuit 36 for keeping the transfer current having an appropriate magnitude constant, a current density with a magnitude in a predetermined range is produced in the aforementioned passage area between the secondary transfer roller 35 and the intermediate transfer belt 14 mounted around the drive roller 12.

As shown in FIG. 2, the aforementioned printing mechanism includes the separating unit 37 arranged immediately after the nip portion between the secondary transfer roller 35 and the intermediate transfer belt 14 (before the fixing device 40 (see FIG. 1)). The separating unit 37 electrically neutralizing a sheet S after the secondary transfer of a toner image facilitates to separate the sheet S from the intermediate transfer belt 14.

The separating unit 37 includes a separation electrode body 53. The printing mechanism further includes a second application circuit 38 electrically connected to the separation electrode body 53. The second application circuit 38 applies a separation voltage to the separation electrode body 53 in order to supply a separation current to cause an electrical discharge from the separation electrode body 53. The electrical discharge from the separation electrode body 53 reduces a charged amount of the sheet S to facilitate separation between the sheet S and the intermediate transfer belt 14. In this embodiment, the separating unit 37 and the second application circuit 38 are exemplified as a separator. The separation electrode body 53 is exemplified as a separation electrode. The second application circuit 38 is exemplified as a second application element.

As shown in FIG. 2, the aforementioned printing mechanism further includes a partition 39 mounted on the separating unit 37. The partition 39 between the separation electrode body 53 and the secondary transfer roller 35 horizontally projects toward the intermediate transfer belt 14.

Figure 3:
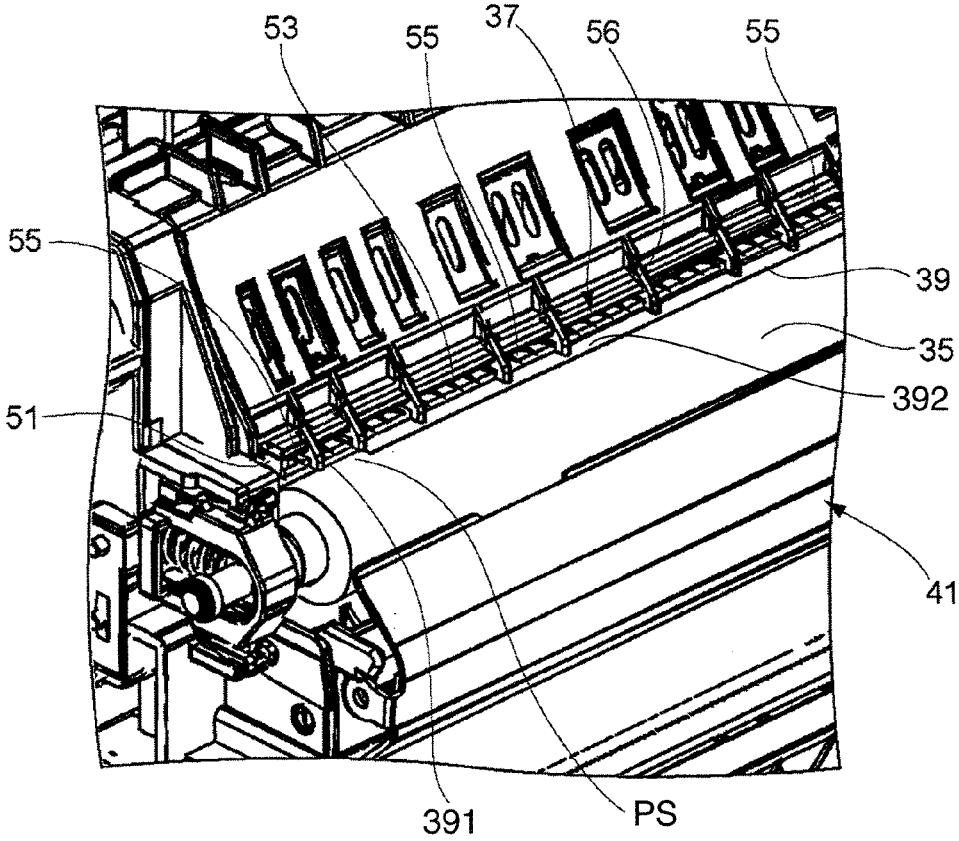
FIG. 3 is a schematic perspective view around the secondary transfer roller shown in FIG. 2.
Figure 4:
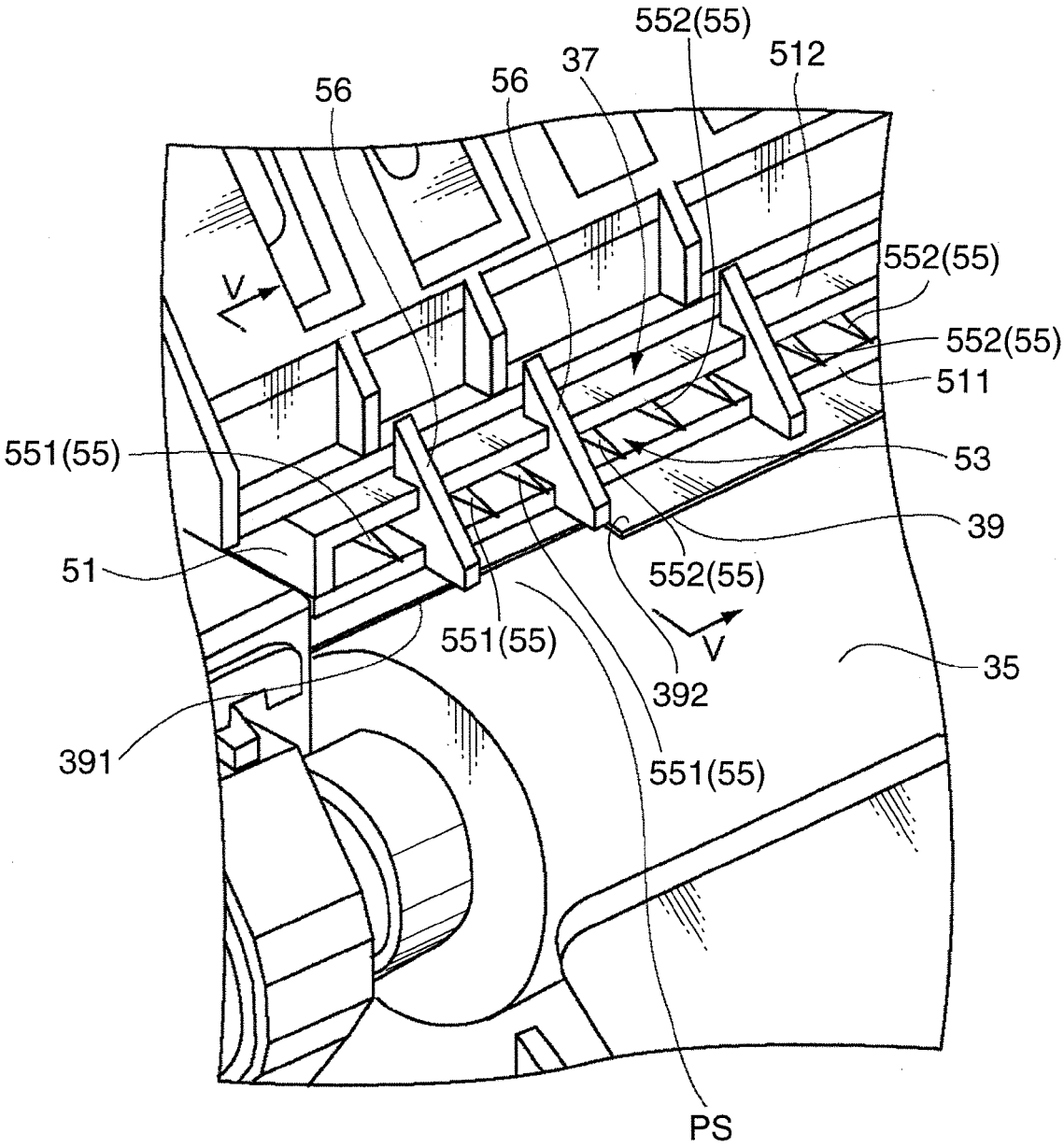
FIG. 4 is an enlarged view around the secondary transfer roller shown in FIG. 3.

FIG. 3 is a perspective view of the secondary transfer roller 35 and the separating unit 37 mounted in the side unit 41 pulled out sideways. FIG. 4 is an enlarged perspective view of the secondary transfer roller 35 and the separating unit 37 shown in FIG. 3. The separating unit 37 and the secondary transfer roller 35 are described with reference to FIGS. 3 and 4.

As shown in FIGS. 3 and 4, the separating unit 37 is very close to the secondary transfer roller 35. Accordingly, the separating unit 37 may perform the aforementioned separating process on a sheet S immediately after the sheet S passes the nip portion between the secondary transfer roller 35 and the intermediate transfer belt 14.

Figure 5:
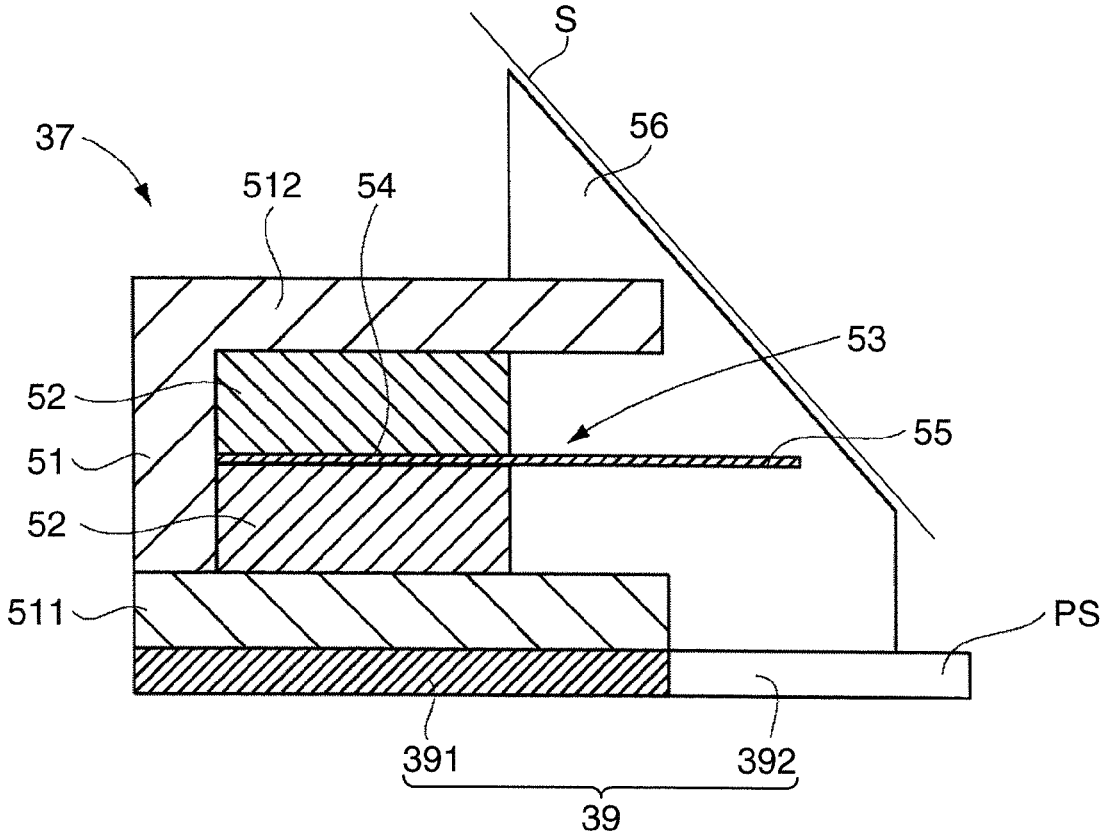
FIG. 5 is a schematic sectional view of a separating unit near the secondary transfer roller shown in FIG. 4.
Figure 6:
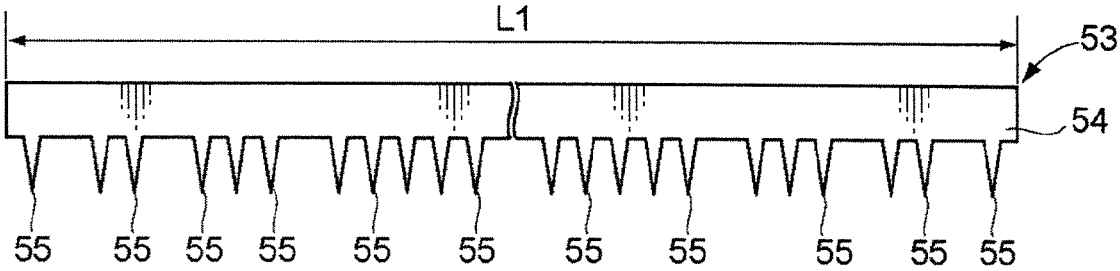
FIG. 6 is a schematic plan view of a separation electrode body installed in the separating unit shown in FIG. 5.

FIG. 5 is a schematic sectional view of the separating unit 37. FIG. 6 is a plan view of the separation electrode body 53. The separating unit 37 is described with reference to FIGS. 1 to 6.

As shown in FIG. 5, the separating unit 37 includes an electrode housing 51 configured to partially accommodate the separation electrode body 53, two supporting members 52 configured to support the separation electrode body 53 in the electrode housing 51 and guide plates 56 configured to guide a sheet S (see FIG. 2) passing between the separation electrode body 53 and the intermediate transfer belt 14 in addition to the aforementioned separation electrode body 53.

As shown in FIGS. 3 and 4, the electrode housing 51 made of an insulating resin material extends along the secondary transfer roller 35. As shown in FIG. 5, the electrode housing 51 includes a base plate 511 and a lid portion 512 having a substantially L-shaped cross section. The two supporting members 52 tightly holding the separation electrode body 53 in the electrode housing 51 are made of an insulating material.

As shown in FIG. 6, the separation electrode body 53 made of a conductive material such as a metal includes an elongated electrode plate 54 extending along the secondary transfer roller 35 and many needle electrodes 55 projecting from an edge of the electrode plate 54 toward the intermediate transfer belt 14. The separation electrode body 53 (electrode plate 54) is substantially as long as or slightly shorter than the secondary transfer roller 35. In FIG. 6, the length of the separation electrode body 53 is indicated by "L1". In this embodiment, the length L1 of the separation electrode body 53 is 306 mm. It should be noted that the length L1 of the separation electrode body 53 is preferably longer than the maximum sheet width.

As shown in FIG. 5, the electrode plate 54 is tightly held by the two supporting members 52. The needle electrodes 55 are aligned along the secondary transfer roller 35. A distance between the needle electrodes 55 at both ends of the electrode plate 54 is substantially as long as the length of the secondary transfer roller 35. Intervals between adjacent needle electrodes 55 are so appropriately set as to effectively electrically neutralize sheets S. In the following description, "along the secondary transfer roller 35" or similar expressions mean to be substantially parallel to a longitudinal direction of the secondary transfer roller 35.

As described above, when the second application circuit 38 applies a separation voltage to the separation electrode body 53, an electrical discharge occurs from sharp tips of the needle electrodes 55. The electrical discharge from the needle electrodes 55 facilitates to separate the sheet S from the intermediate transfer belt 14.

As shown in FIG. 5 as well as FIG. 2, the needle electrodes 55 project from the electrode plate 54 tightly held by the two supporting members 52 toward the intermediate transfer belt 14 mounted around the drive roller 12.

As shown in FIG. 2, the second application circuit 38 is electrically connected to the separation electrode body 53. The second application circuit 38 configured to execute the constant current control applies a separation voltage (bias voltage) having a polarity opposite to that of the transfer voltage to the separation electrode body 53. As a result, an electrical discharge occurs from the needle electrodes 55. The second application circuit 38 may be mounted on the rear wall of the housing 6 together with the aforementioned first application circuit 36.

The aforementioned guide plates 56 configured to guide a sheet S passing between the separation electrode body 53 and the intermediate transfer belt 14 leads to less contact of the sheet S with the needle electrodes 55. The guide plates 56 are arranged between adjacent needle electrodes 55. Like the needle electrodes 55, the guide plates 56 are aligned along the secondary transfer roller 35. Intervals of the guide plates 56 are so determined as to stably support the sheet S.

Figure 7:
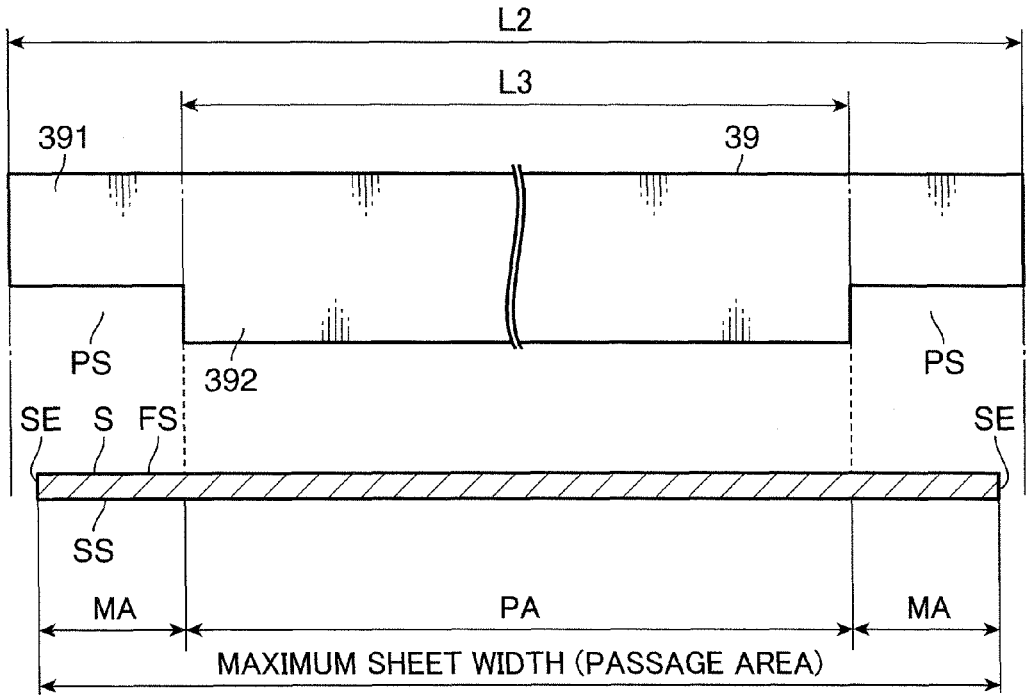
FIG. 7 is a schematic plan view of a partition included in the separating unit shown in FIG. 5 and a sectional view of a sheet being conveyed in the image forming apparatus shown in FIG. 1.

FIG. 7 is a schematic plan view of the partition 39 and a schematic sectional view of a sheet S having the maximum width. The partition 39 is described with reference to FIGS. 1, 2, 5 and 7.

As shown in FIG. 2, the partition 39 is arranged between the secondary transfer roller 35 and the separation electrode body 53. As shown in FIG. 5, the partition 39 is mounted on a lower surface of the base plate 511 of the electrode housing 51. The partition 39 includes an elongated portion 391 extending along the secondary transfer roller 35 and a projecting portion 392 projecting from an edge of the elongated portion 391 toward the intermediate transfer belt 14. The partition 39 is substantially as long as or slightly shorter than the separation electrode body 53. In FIG. 7, the length of the partition 39 is indicated by "L2". In this embodiment, the length L1 of the separation electrode body 53 is 306 mm whereas the length L2 of the partition 39 is 310 mm.

As shown in FIG. 7, the projecting portion 392 of the partition 39 projects from a central part of the elongated portion 391 toward a sheet S passing the aforementioned discharge conveyance path 305. The projecting portion 392 projects more from the electrode housing 51 than the aforementioned needle electrodes 55. Thus, the projecting portion 392 crosses a space between the needle electrodes 55 and the secondary transfer roller 35. Therefore, the projecting portion 392 suppresses interference between the transfer voltage and the separation voltage.

The projecting portion 392 of the partition 39 is shorter than the elongated portion 391. Accordingly, both ends of the partition 39 do not project toward the sheet S. Spaces PS adjacent to the projecting portion 392 allow a current to flow from the secondary transfer roller 35 to the needle electrodes 55. As described above, when the first application circuit 36 applies the transfer voltage to the secondary transfer roller 35, a part of the transfer current supplied to the secondary transfer roller 35 flows to the needle electrodes 55 via the spaces PS (an electrical discharge occurs between the secondary transfer roller 35 and the needle electrodes 55). The projecting portion 392 interferes with the flow of the transfer current toward the needle electrodes 55.

As shown in FIG. 4, the needle electrodes 55 include first needle electrodes 551 provided in correspondence with the spaces PS and second needle electrodes 552 provided in correspondence with the projecting portion 392. A part of the transfer current flows through the spaces PS between the first needle electrodes 551 and the secondary transfer roller 35. The projecting portion 392 of the partition 39 interferes with the flow of the transfer current between the second needle electrodes 552 and the secondary transfer roller 35. In this embodiment, the first needle electrode 551 is exemplified as a first separation electrode and the second needle electrode 552 is exemplified as a second separation electrode.

As shown in FIG. 7, the first needle electrodes 551 are preferably closer to the lateral edges SE of the sheet S than the second needle electrodes 552, which leads to less transfer failures resulting from interference between the transfer voltage and the separation voltage.

As shown in FIG. 7, the copier 1 is generally so set as to define, on a sheet S, a print area PA where a toner image is printed and margin areas MA where no toner image is printed. The margin areas MA extend along the both lateral edges SE of the sheet S. The print area PA is adjacent to the margin areas MA. In this embodiment, the margin areas MA are exemplified as a first area while the print area PA is exemplified as a second area. The print area PA is 280 mm in width.

A sheet S includes a first surface FS and a second surface SS opposite to the first surface FS. When a user uses the operation unit 4 to instruct the copier 1 to perform duplex printing, a first toner image formed first by the image forming portions 16 is printed within the print area PA of the first surface FS. A second toner image formed later by the image forming portions 16 is printed within the print area PA of the second surface SS. On the other hand, no toner image is printed on the margin areas MA.

The spaces PS (and the first needle electrodes 551) allowing the transfer current to flow from the secondary transfer roller 35 to the first needle electrodes 551 correspond to the margin areas MA. The projecting portion 392 of the partition 39 (and the second needle electrodes 552) corresponds to the print area PA. In FIG. 7, the length of the projecting portion 392 is indicated by "L3". In this embodiment, the length L3 of the projecting portion 392 is substantially equal to the width of the print area PA. Alternatively, the length L3 of the projecting portion 392 may be longer than the width of the print area PA. In this case, a distance between the paired spaces PS is longer than the width of the print area PA.

The length L3 and/or arrangement of the projecting portion 392 are so determined that the spaces PS do not overlap the print area PA. The length of the spaces PS is determined according to the width of the margin areas MA set in the copier 1. In this embodiment, the space PS is, for example, 10 mm in length.

(Operation of Imaging Forming Apparatus)

The operation of the copier 1 is described with reference to FIGS. 1, 2, 5 and 7.

The charger 22 of the image forming portion 16 uniformly charges the circumferential surface of the photoconductive drum 21. Thereafter, the exposure device 23 irradiates the circumferential surface of the photoconductive drum 21 with a laser beam in accordance with a document image read by the scanner to form an electrostatic latent image.

The developing device 24 charges the toner. The charged toner is supplied from the developing device 24 to the circumferential surface of the photoconductive drum 21 on which the electrostatic latent image is formed. As a result, the toner is electrostatically attracted to the electrostatic latent image, so that the electrostatic latent image is developed by the toner attracted thereto to become a toner image.

As described in the context of FIG. 1, the four image forming portions 16 form magenta, cyan, yellow and black toner images, respectively. The magenta, cyan, yellow and black toner images are successively transferred to the outer surface of the intermediate transfer belt 14 passing between the photoconductive drums 21 and the primary transfer rollers 17 (primary transfer). The magenta, cyan, yellow and black toner images are superimposed on the intermediate transfer belt 14 into one color toner image.

As described above, a sheet S is conveyed from the sheet cassette 7 to the registration roller unit 301 through the conveyance path 32. Thereafter, the registration roller unit 301 feeds the sheet S to the nip portion defined between the secondary transfer roller 35 and the intermediate transfer belt 14 mounted around the drive roller 12 in synchronism with a secondary transfer timing. The toner image is transferred from the intermediate transfer belt 14 to the sheet S (secondary transfer) while the sheet S passes the nip portion between the secondary transfer roller 35 and the intermediate transfer belt 14.

Thereafter, the fixing device 40 fixes the toner image to the sheet S. If a user operates the operation panel 4 to instruct the copier 1 to perform simplex printing, the discharge roller unit 306 discharges the sheet S onto the discharge tray 5.

If the user operates the operation panel 4 to instruct the copier 1 to perform duplex printing, the sheet S is guided to the branch conveyance path 34. A switchback operation (operation of conveying the sheet S such that the leading edge and the trailing edge of the sheet S are reversed) is performed while the sheet S is guided in the branch conveyance path 34. As shown in FIG. 1, the branch conveyance path 34 joins the conveyance path 32 immediately before the registration roller unit 301. The switched-back sheet S is fed to the nip portion between the secondary transfer roller 35 and the intermediate transfer belt 14 again by the registration roller unit 301 after passing through the branch conveyance path 34. The second surface SS of the sheet S arriving at the nip portion faces the intermediate transfer belt 14. It should be noted that a toner image is transferred to the first surface FS of the sheet S when the first S is first fed to the nip portion between the secondary transfer roller 35 and the intermediate transfer belt 14.

In the nip portion between the secondary transfer roller 35 and the intermediate transfer belt 14, a toner image is transferred to the second surface SS of the sheet S (secondary transfer). Thereafter, the toner image on the second surface SS is fixed by the fixing device 40. The sheet S having the toner images fixed to the first and second surfaces FS, SS is discharged onto the discharge tray 5 by the discharge roller unit 306 thereafter.

During the aforementioned secondary transfer, the first application circuit 36 applies a transfer voltage having a polarity opposite to that of a charging voltage to the toner. As a result, the toner adhering to the outer surface of the intermediate transfer belt 14 transfers to the sheet S. Thus, the secondary transfer of the toner image is achieved.

The application of the transfer voltage by the first application circuit 36 charges the sheet S. As a result, the sheet S immediately after the secondary transfer is attracted toward the intermediate transfer belt 14. When the sheet S passes between the separating unit 37 and the intermediate transfer belt 14, the separating unit 37 electrically neutralizes the sheet S as described above to facilitate to separate the sheet S from the intermediate transfer belt 14.

During the aforementioned secondary transfer, the second application circuit 38 applies a separation voltage having a polarity opposite to that of the transfer voltage to the separation electrode body 53 of the separating unit 37. The application of the separation voltage by the second application circuit 38 induces an ion discharge from/to the sheet S passing between the separating unit 37 and the intermediate transfer belt 14 to/from the needle electrodes 55 to reduce a charged amount of the sheet S so as to facilitate to separate the sheet S from the intermediate transfer belt 14.

As described above, the first application circuit 36 supplies the transfer current to the secondary transfer roller 35 during the secondary transfer of the toner image. A part of the transfer current supplied to the secondary transfer roller 35 flows to the first needle electrodes 551 through the spaces PS adjacent to the projecting portion 392 of the partition 39. The first application circuit 36 maintains a current density in a sheet passage area so as to compensate for the part of the transfer current flowing to the first needle electrodes 551. The first application circuit 36, therefore, increases an absolute value of the transfer current for compensation of the part of the transfer current, which flows to the first needle electrodes 551. On the other hand, it contributes to a reduction in an absolute value of the transfer voltage to allow the transfer current to flow to the first needle electrodes 551. Thus, the transfer voltage is less likely to increase even if an electrical resistance of the sheet S passing between the secondary transfer roller 35 and the intermediate transfer belt 14 mounted around the drive roller 12 is higher. Therefore, an electrical discharge from the secondary transfer roller 35 and/or the sheet S resulting from the increase in the transfer voltage is preferably less likely to occur, which preferably results in less incomplete transfer of a toner image.

A resistance value of the sheet S after the toner image is transferred to the first surface FS is potentially larger as compared with the one before the toner image is transferred. As described above, a larger resistance value of the sheet S is likely to cause incomplete transfer of the toner image. In this embodiment, the partition 39 allows the part of the transfer current to flow to the first needle electrodes 551, which preferably results in less incomplete transfer of a toner image to a sheet even which has a larger resistance value.

(Experiment)

Figure 8A:
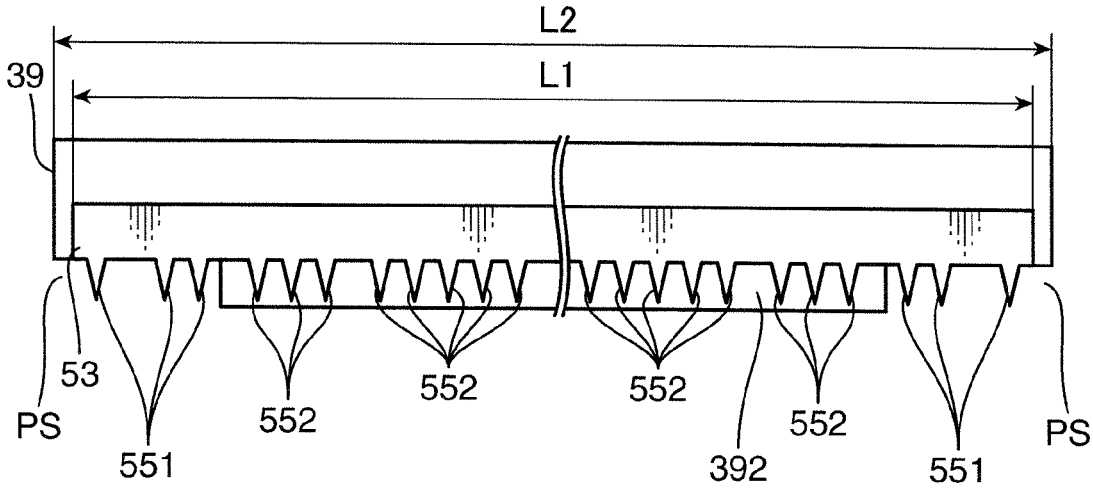
FIG. 8A is a schematic plan view of the separation electrode body arranged on the partition shown in FIG. 7.
Figure 8B:
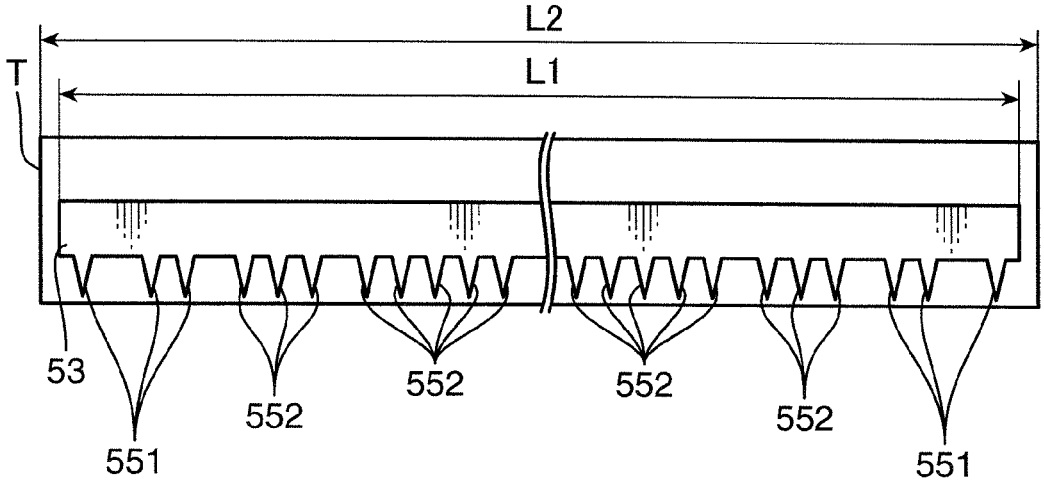
FIG. 8B is a schematic plan view of a partition overlapping all needle electrodes of the separation electrode body shown in FIG. 6.

FIG. 8A is a schematic plan view showing the partition 39 and the separation electrode body 53 attached to the partition 39. FIG. 8B is a schematic plan view showing a partition T used for a comparative experiment and the separation electrode body 53 attached to the partition T. An effect of the transfer current flowing between the secondary transfer roller 35 and the first needle electrodes 551 is described with reference to FIGS. 4, 7, 8A and 8B.

As described above, the partition 39 is longer than the separation electrode body 53. The partition T longer than the separation electrode body 53 similarly to the partition 39 was prepared. As shown in FIG. 8A, the partition 39 does not overlap the first needle electrodes 551 while overlapping the second needle electrodes 552. Thus, the partition 39 allows the transfer current to flow between the secondary transfer roller 35 and the first needle electrodes 551. On the other hand, as shown in FIG. 8B, the partition T overlaps not only the second needle electrodes 552 but also the first needle electrodes 551. Thus, the partition T does not allow the transfer current to flow between the secondary transfer roller 35 and the first needle electrodes 551.

Further, sheets S having a toner image transferred to a first surface FS thereof, respectively, were prepared. The sheets S were 297 mm in width (A4 size). A current density in the passage area was kept at −1.2 μA/cm to −1.3 μA/cm during transfer of a toner image to a second surface SS.

When the partition T was used, the transfer current was set at −37.5 μA. At this time, the transfer voltage was −1.67 kV. As a result of observing the toner image transferred to the second surface SS, incomplete transfer of the toner image was confirmed.

A transfer voltage of −3.8 μA flowed from the secondary transfer roller 35 to the first needle electrodes 551 when the partition 39 was used. Thus, the transfer current was set at −41.3 μA for compensation of the transfer current flowing from the secondary transfer roller 35 to the first needle electrodes 551 and keep the current density in the passage area in a range of −1.2 μA/cm to −1.3 μA/cm. At this time, the transfer voltage was −1.53 kV. As a result of observing the toner image transferred to the second surface SS, no incomplete transfer of the toner image was confirmed.

The flow of the transfer current from the secondary transfer roller 35 to the first needle electrodes 551 means that the transfer voltage interferes with the separation voltage at both ends of the secondary transfer roller 35. As a result of observing the toner image on the second surface SS obtained when using the partition 39, however, no transfer failure resulting from the interference between the transfer voltage and the separation voltage was observed.

As described above, the copier 1 may reduce the transfer voltage while keeping an appropriate current density for the secondary transfer. Thus, a toner image with a higher image quality is formed on a sheet S even which has a larger resistance value (e.g. sheet S after a toner image is transferred to the first surface FS) with much less incomplete transfer of the toner image.

The partition 39 includes the projecting portion 392 overlapping some of the needle electrodes 55. As a result, the spaces PS for allowing the transfer current to flow from the secondary transfer roller 35 to the first needle electrodes 551 are formed. The transfer current flowing from the secondary transfer roller 35 to the first needle electrodes 551 is preferably less likely to cause the incomplete transfer of the toner image. Thus, it is not necessary to extend the secondary transfer roller 35, which leads to a larger size of the copier 1, for the purpose of preventing the incomplete transfer of the toner image.

The circumferential surfaces of the photoconductive drums 21 used in the tandem copier 1 described in the context of FIGS. 1 and 2 are made of amorphous silicon. The amorphous silicon has a larger capacitance than organic photoconductors. Conditions such as the "tandem copier 1" and the "photoconductive drums 21 including amorphous silicon" require a larger absolute value of a transfer voltage to be applied to the secondary transfer roller 35. Thus, the copier 1 described in the context of this embodiment includes disadvantageous structural conditions in terms of the incomplete transfer of the toner image. However, since the copier 1 allows the transfer current to flow from the secondary transfer roller 35 to the first needle electrodes 551, the aforementioned disadvantageous structural conditions may be overcome, so that less incomplete transfer of the toner image may occur.

A reduction in the transfer voltage leads to an increase in the durability of the secondary transfer roller 35. Thus, a longer life of the copier 1 is achieved.

As described in the context of FIG. 7, the first needle electrodes 551 that receive the transfer current from the secondary transfer roller 35 (and the spaces PS for allowing the transfer current to pass from the secondary transfer roller 35) correspond to the margin areas MA of the sheet S. Therefore, it is unlikely that a failure in the secondary transfer resulting from the interference between the transfer voltage and the separation voltage is caused in the print area PA.

SECOND EMBODIMENT

Separating Unit

Figure 9:
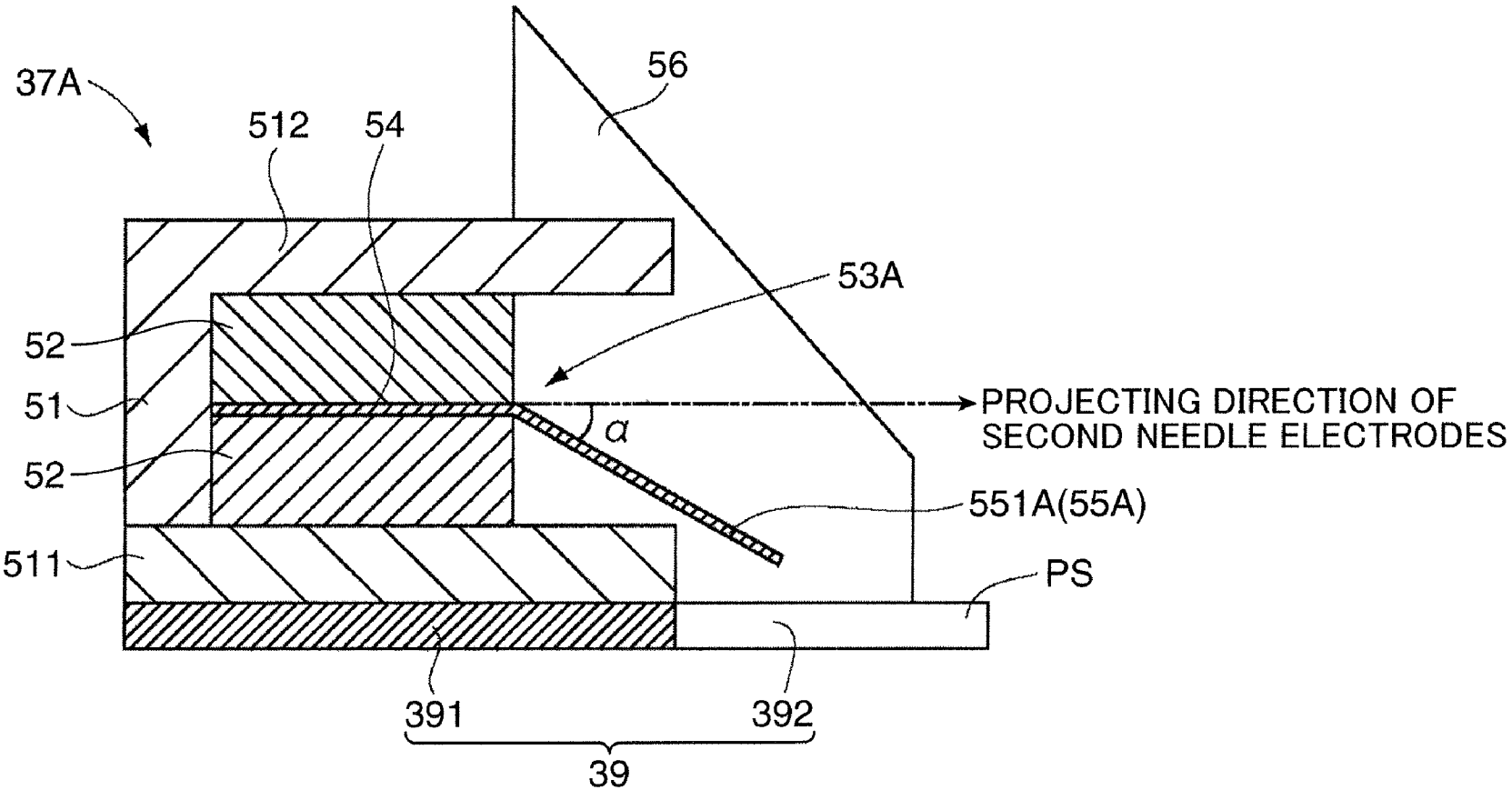
FIG. 9 is a schematic sectional view of a separating unit used in a copier exemplified as an image forming apparatus according to a second embodiment.

FIG. 9 is a schematic sectional view of a separating unit used in an image forming apparatus according to a second embodiment. Features different from those of the first embodiment are described below. Accordingly, redundant descriptions with respect to the first embodiment are omitted. In the following description, the same reference numerals are allotted to the same elements as in the first embodiment. The description in the context of the first embodiment is preferably employed for elements that are not described below. The image forming apparatus according to the second embodiment is described with reference to FIG. 9.

A separating unit 37A provided in a copier 1A includes a separation electrode body 53A. The separating unit 37A also includes an electrode housing 51 configured to partially accommodate the separation electrode body 53A, two supporting members 52 configured to support the separation electrode body 53A in the electrode housing 51 and guide plates 56 configured to guide a sheet S passing between the separation electrode body 53A and an intermediate transfer belt 14. The electrode housing 51, the supporting members 52 and the guide plates 56 are the same as in the first embodiment. Further, like the first embodiment, a partition 39 is mounted on a base plate 511 of the electrode housing 51. The separation electrode body 53A is as long as the separation electrode body 53 described in the context of the first embodiment.

Figure 10:
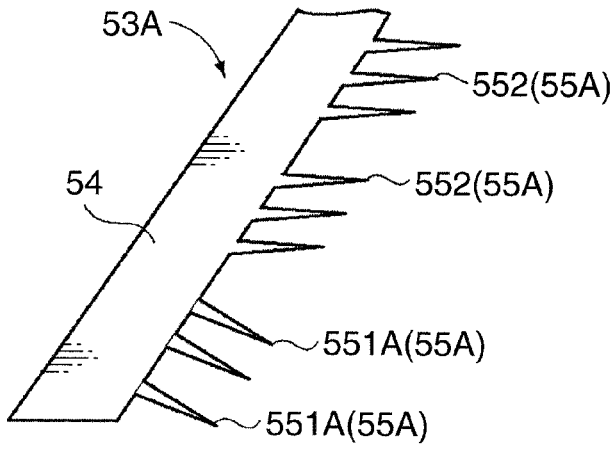
FIG. 10 is a schematic perspective view of a separation electrode body shown in FIG. 9.

FIG. 10 is a schematic perspective view of the separation electrode body 53A. The separation electrode body 53A is described with reference to FIGS. 1, 9 and 10.

As shown in FIG. 10, the separation electrode body 53A made of a conductive material such as a metal includes an electrode plate 54 described in the context of the first embodiment and many needle electrodes 55A projecting from an edge of the electrode plate 54. The needle electrodes 55A include first needle electrodes 551A and second needle electrodes 552 similarly to the first embodiment. Projecting positions of the first needle electrodes 551A from the electrode plate 54 are the same as those of the first needle electrodes 551 described in the context of the first embodiment.

As shown in FIG. 9, a projecting direction of the first needle electrodes 551A is inclined downward by an angle $\alpha$ with respect to a projecting direction of the second needle electrodes 552. The angle $\alpha$ is preferably set at 15° to 45°. More preferably, the angle $\alpha$ is set at 30°. As shown in FIG. 1, the secondary transfer roller 35 is arranged below the separating unit 37A. Thus, the second needle electrodes 552 project toward an intermediate transfer belt 14 similarly to the first embodiment, whereas the first needle electrodes 551A project toward the secondary transfer roller 35. In this embodiment, the first needle electrodes 551A are exemplified as a first separation electrode and the second needle electrodes 552 as a second separation electrode.

Figure 11:
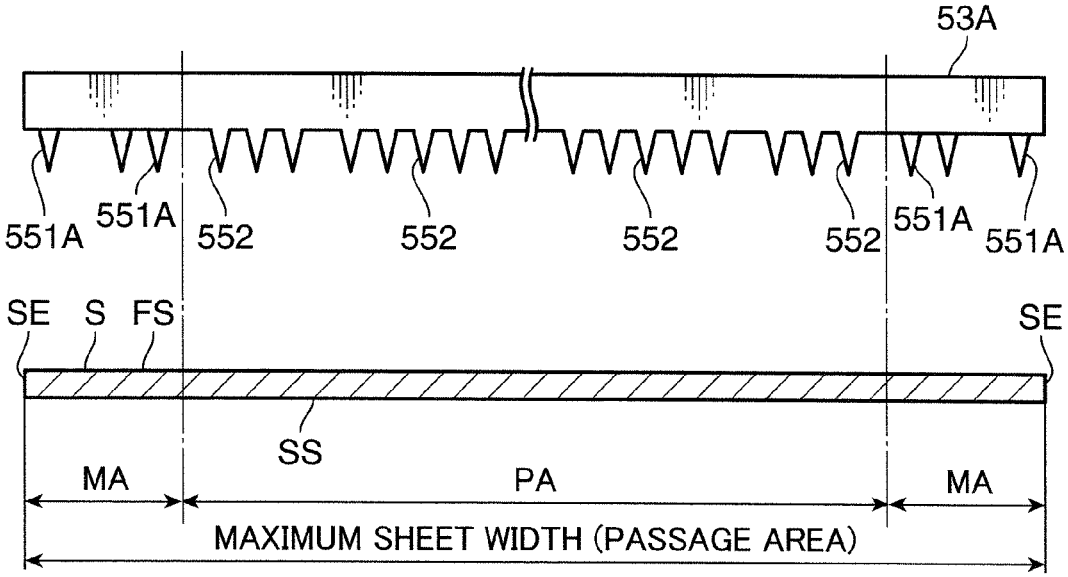
FIG. 11 is a schematic plan view of the separation electrode body shown in FIG. 10 and a sectional view of a sheet being conveyed in the image forming apparatus shown in FIG. 1.

FIG. 11 is a schematic plan view of the separation electrode body 53A and a schematic sectional view of a sheet S having the maximum width. A positional relationship of the sheet S and the first needle electrodes 551A/second needle electrodes 552 is described with reference to FIGS. 1 and 11.

The first needle electrodes 551A are closer to lateral edges SE of the sheet S than the second needle electrodes 552. Like the first embodiment, the second needle electrodes 552 are formed in correspondence with a print area PA. On the other hand, the first needle electrodes 551A are formed in correspondence with margin areas MA. Tips of the first needle electrodes 551A corresponding to the margin areas MA are closer to the secondary transfer roller 35 than those of the second needle electrodes 552.

As described above, since the tips of the first needle electrodes 551A corresponding to the margin areas MA are proximate to the secondary transfer roller 35, more transfer current is likely to flow to the first needle electrodes 551A as compared with the first needle electrodes 551 described in the context of the first embodiment. As a result, the transfer voltage is further reduced as compared with the first embodiment. Therefore, further less incomplete transfer occurs.

(Effect on Incomplete Transfer)

Sheets S which have toner images on first surfaces FS thereof, respectively, were prepared. The sheets S were 297 mm in width (A4 size). A current density in the passage area was kept at −1.2 μA/cm to −1.3 μA/cm during transfer of a toner image to a second surface SS.

A transfer current of −4.5 μA flowed from the secondary transfer roller 35 to the first needle electrodes 551A when the separation electrode body 53A was used. Thus, the transfer current was set at −42 μA for compensation of the transfer current flowing from the secondary transfer roller 35 to the first needle electrodes 551A and keep the current density in a passage area in a range of −1.2 μA/cm to −1.3 μA/cm. At this time, the transfer voltage was −1.48 kV. As a result of observing the toner image transferred to the second surface SS, no incomplete transfer of the toner image was confirmed.

Figure 12:
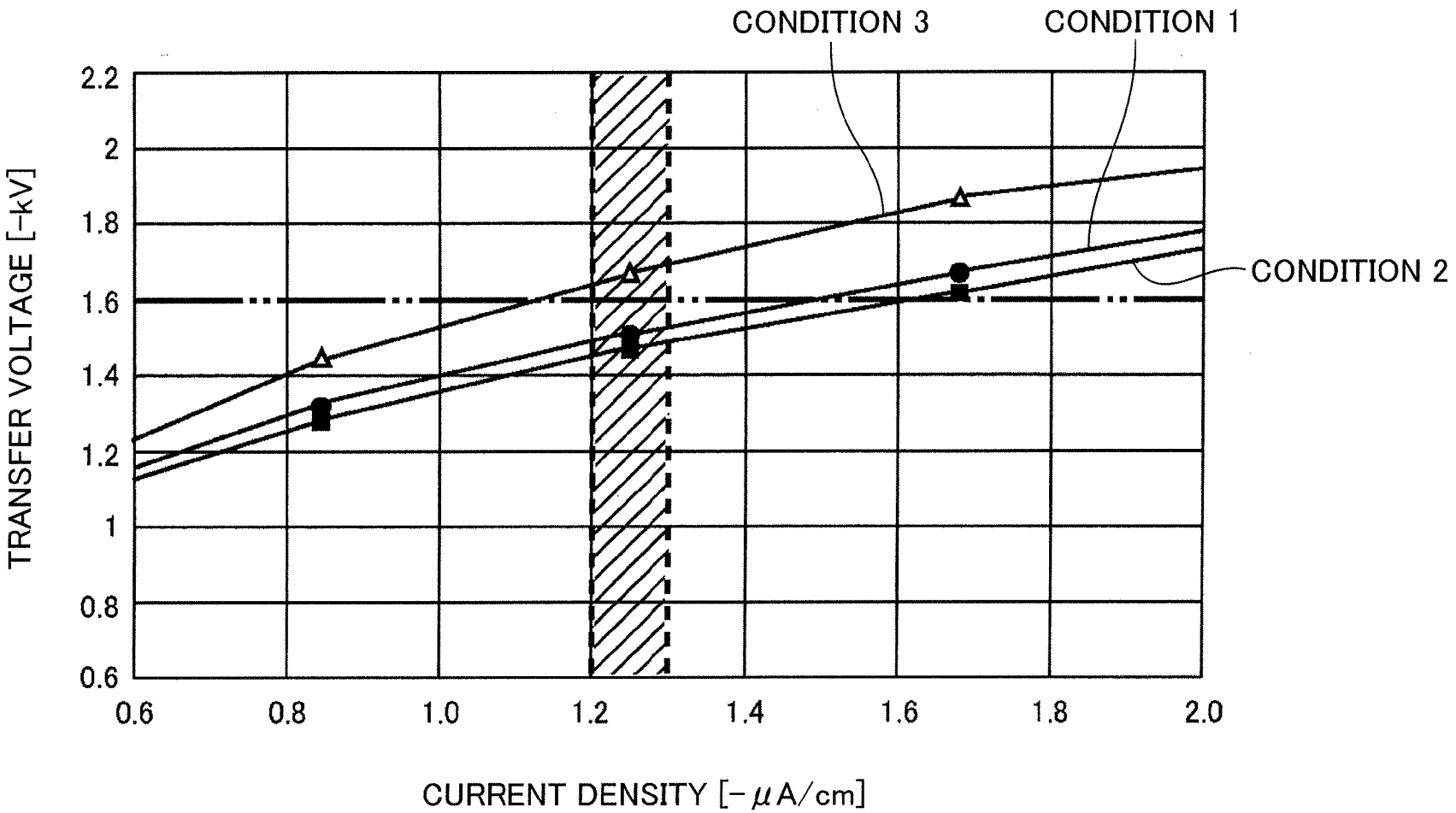
FIG. 12 is a graph schematically showing a relationship between a current density and a transfer voltage.

FIG. 12 is a graph showing a relationship between the current density and the transfer voltage. Effects of the partition 39 and the separation electrode bodies 53, 53A are described with reference to FIG. 12.

A condition 1 shown in FIG. 12 is a curve representing a relationship between the current density and the transfer voltage at the time of using the separating unit 37 described in the context of the first embodiment. A condition 2 shown in FIG. 12 is a curve representing a relationship between the current density and the transfer voltage at the time of using the separating unit 37A described in the context of the second embodiment. A condition 3 shown in FIG. 12 is a curve representing a relationship between the current density and the transfer voltage at the time of replacing the partition 39 of the separating unit 37 with the partition T described in the context of the first embodiment.

Through the conditions 1 to 3, a current density suitable for the secondary transfer in the passage area was −1.26 μA/cm. On the condition 3, the transfer voltage required to achieve the current density of −1.26 μA/cm was −1.67 kV. On the condition 1, the transfer voltage required to achieve the current density of −1.26 μA/cm was −1.53 kV. Thus, a smaller absolute value of the transfer voltage was obtained under the condition 1 than under the condition 3. On the condition 2, the transfer voltage required to achieve the current density of −1.26 μA/cm was −1.48 kV. Thus, a further smaller absolute value of the transfer voltage was obtained under the condition 2 than under the condition 1.

Incomplete transfer of a toner image was confirmed on the condition 3, whereas no incomplete transfer of a toner image was confirmed on the conditions 1 and 2. Accordingly, the first embodiment preferably suppresses the incomplete transfer of the toner image by reducing the transfer voltage. The second embodiment more preferably suppresses the incomplete transfer because of a lower transfer voltage than in the first embodiment.

In this embodiment, a pair of groups of the first needle electrodes 551A are provided in correspondence with a pair of margin areas MA extending along the both lateral edges SE of the sheet S. Alternatively, a group of the first needle electrodes 551A may be provided in correspondence with one of the paired margin areas MA and a group of the first needle electrodes 551 described in the context of the first embodiment may be provided in correspondence with the other margin area MA.

In this embodiment, the first needle electrodes 551A are bent at their boundaries with the electrode plate 54. Alternatively, the first needle electrodes 551A may be bent at their intermediate positions.

In this embodiment, the first needle electrodes 551A project straight toward the secondary transfer roller 35. Alternatively, the first needle electrodes 551A may be curved toward the secondary transfer roller 35.

THIRD EMBODIMENT

Separating Unit

Figure 13:
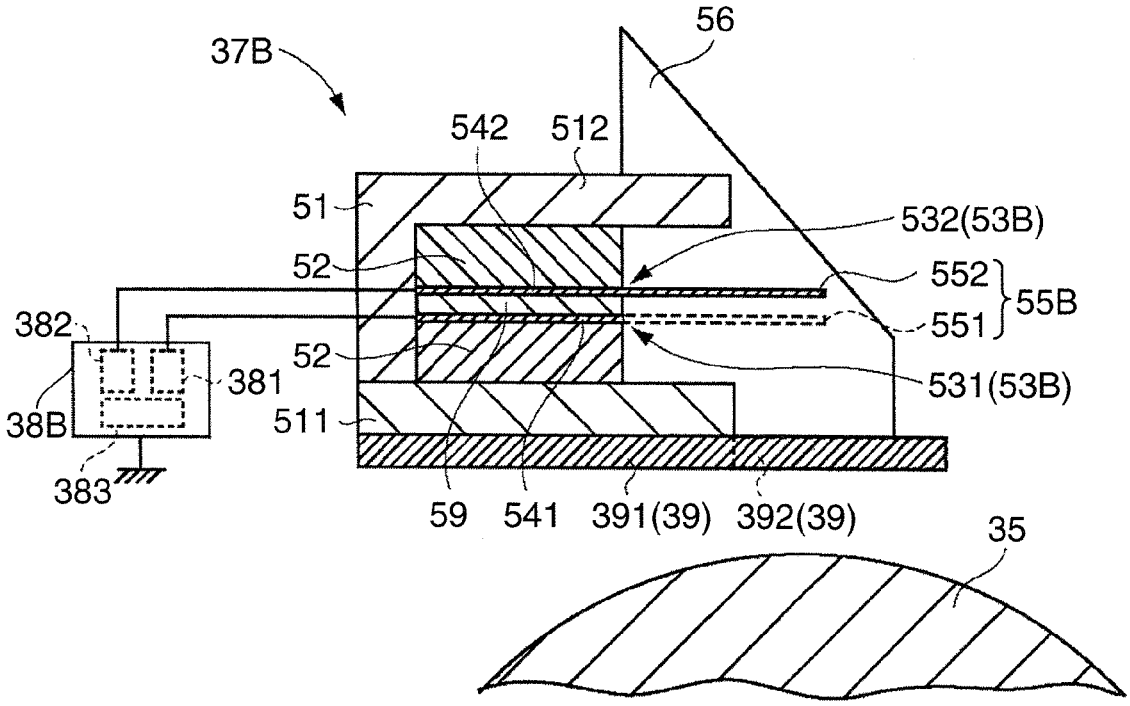
FIG. 13 is a schematic sectional view of a separating unit used in a copier exemplified as an image forming apparatus according to a third embodiment.

FIG. 13 is a schematic sectional view of a separating unit used in an image forming apparatus according to a third embodiment. Features different from those of the first embodiment are described below. Accordingly, redundant descriptions with respect to the first embodiment are omitted. In the following description, the same reference numerals are allotted to the same elements as in the first embodiment. The description in the context of the first embodiment is preferably employed for elements that are not described below. The image forming apparatus according to the third embodiment is described with reference to FIG. 13.

A separating unit 37B includes a separation electrode body 53B and an insulating plate 59. The separation electrode body 53B includes a first separation electrode body 531 and a second separation electrode body 532 arranged on the first separation electrode body 531. The first and second separation electrode bodies 531, 532 are made of conductive materials such as metal. The insulating plate 59 is arranged between the first and second separation electrode bodies 531, 532.

The separating unit 37B also includes an electrode housing 51 configured to partially accommodate the separation electrode body 53B, two supporting members 52 configured to support the separation electrode body 53B in the electrode housing 51 and guide plates 56 configured to guide a sheet S passing between the separation electrode body 53B and an intermediate transfer belt 14. The electrode housing 51, the supporting members 52 and the guide plates 56 are the same as in the first embodiment.

Figure 14:
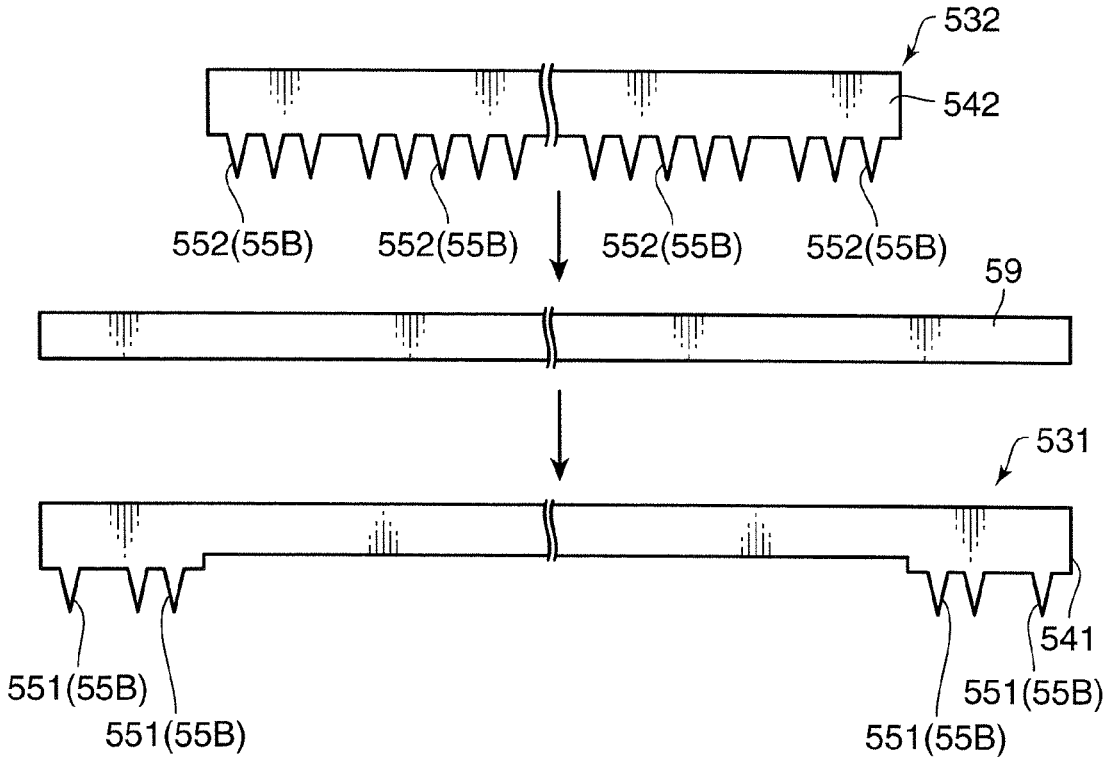
FIG. 14 is a plan view showing a first separation electrode body, a second separation electrode body and an insulating plate included in the separating unit shown in FIG. 13.

FIG. 14 is a schematic plan view showing the first separation electrode body 531, the insulating plate 59 and the second separation electrode body 532. The first separation electrode body 531, the insulating plate 59 and the second separation electrode body 532 are described with reference to FIGS. 1, 13 and 14.

The separation electrode body 53B includes needle electrodes 55B. The needle electrodes 55B include first needle electrodes 551 and second needle electrodes 552. The first separation electrode body 531 includes an elongated first electrode plate 541 extending along the secondary transfer roller 35. The first needle electrodes 551 project from an edge of the first electrode plate 541 toward the intermediate transfer belt 14. The second separation electrode body 532 includes an elongated second electrode plate 542 extending along the secondary transfer roller 35. The second needle electrodes 552 project from an edge of the second electrode plate 542 toward the intermediate transfer belt 14.

The elongated insulating plate 59 tightly holds the first and second electrode plates 541, 542 in cooperation with the supporting members 52 in the electrode housing 51. The insulating plate 59 insulates the first electrode plate 541 against the second electrode plate 542.

In this embodiment, the first separation electrode body 531 and the insulating plate 59 are as long as the separation electrode body 53 described in the context of the first embodiment. The second separation electrode body 532 is shorter than the first separation electrode body 531 and the insulating plate 59. In this embodiment, the first separation electrode body 531 and the insulating plate 59 are 306 mm in length.

The insulating plate 59 is arranged on the first electrode plate 541 of the first separation electrode body 531. The second electrode plate 542 of the second separation electrode body 532 is arranged on the insulating plate 59. Accordingly, the first needle electrodes 551 are closer to the secondary transfer roller 35 than the second needle electrodes 552.

Figure 15:
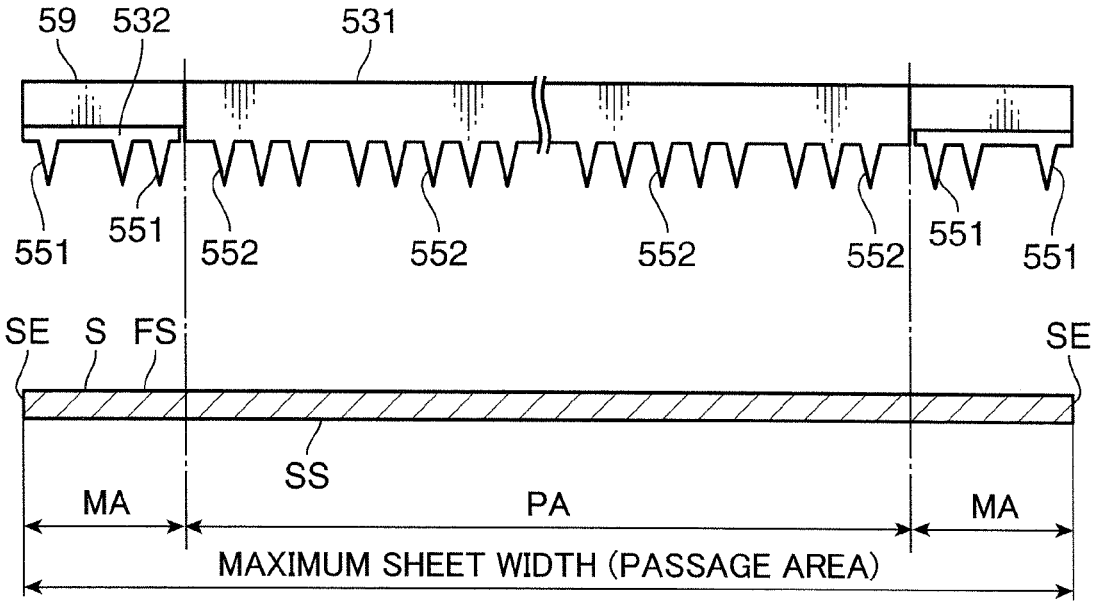
FIG. 15 is a schematic plan view of the first separation electrode body, the second separation electrode body and the insulating plate shown in FIG. 14 and a sectional view of a sheet being conveyed in the image forming apparatus shown in FIG. 1.

FIG. 15 is a schematic plan view of an assembly of the first separation electrode body 531, the insulating plate 59 and the second separation electrode body 532 and a schematic sectional view of a sheet S having the maximum width. An arrangement of the first and second needle electrodes 551, 552 is described with reference to FIG. 15.

The first needle electrodes 551 are closer to lateral edges SE of the sheet S than the second needle electrodes 552. Like the first embodiment, the second needle electrodes 552 are formed in correspondence with a print area PA. The first needle electrodes 551 are formed in correspondence with margin areas MA. Tips of the first needle electrodes 551 corresponding to the margin areas MA are closer to the secondary transfer roller 35 than those of the second needle electrodes 552.

Voltage application to the separation electrode body 53B is described with reference to FIGS. 13 and 15.

A copier 1B according to this embodiment includes a second application circuit 38B electrically connected to the separation electrode body 53B. The second application circuit 38B applies a separation voltage (bias voltage) having a polarity opposite to a transfer voltage to the separation electrode body 53B. As a result, an electrical discharge from the separation electrode body 53B occurs. The electrical discharge from the separation electrode body 53B reduces a charged amount of the sheet S to facilitate separation between the sheet S and the intermediate transfer belt 14. The second application circuit 38B may be mounted on a rear wall of a housing 6. In this embodiment, the separating unit 37 and the second application circuit 38B are exemplified as a separator. The separation electrode body 53B is exemplified as a separation electrode. The second application circuit 38B is exemplified as a second application element.

The second application circuit 38B includes a first constant current circuit 381 configured to apply the separation voltage to the first separation electrode body 531, a second constant current circuit 382 configured to apply the separation voltage to the second separation electrode body 532, and a control circuit 383 configured to control the first and second constant current circuits 381, 382. The first constant current circuit 381 is electrically connected to the first separation electrode body 531. The second constant current circuit 382 is electrically connected to the second separation electrode body 532.

The control circuit 383 independently controls the first and second constant current circuits 381, 382. Thus, the second constant current circuit 382 may supply a second separation current, which has a magnitude different from that of a first separation current to be supplied to the first separation electrode body 531 by the first constant current circuit 381, to the second separation electrode body 532 if necessary.

In this embodiment, when a toner image is secondarily transferred to a first surface FS of a sheet S, the control circuit 383 executes such a control as to substantially match the magnitude of the first separation current with that of the second separation current. As a result, the separation current is uniformly supplied to the first separation electrode body 531 (first needle electrodes 551) and the second separation electrode body 532 (second needle electrodes 552). The control circuit 383 sets an absolute value of the first separation current to be larger than that of the second separation current when the toner image is secondarily transferred to a second surface SS of the sheet S. When the toner image is secondarily transferred to the second surface SS of the sheet S, the first separation current of, e.g. −20 μA may be supplied from the first constant current circuit 381 to the first separation electrode body 531. Further, when the toner image is secondarily transferred to the second surface SS of the sheet S, the second separation current of, e.g. −10 μA may be supplied from the second constant current circuit 382 to the second separation electrode body 532.

Figure 16:
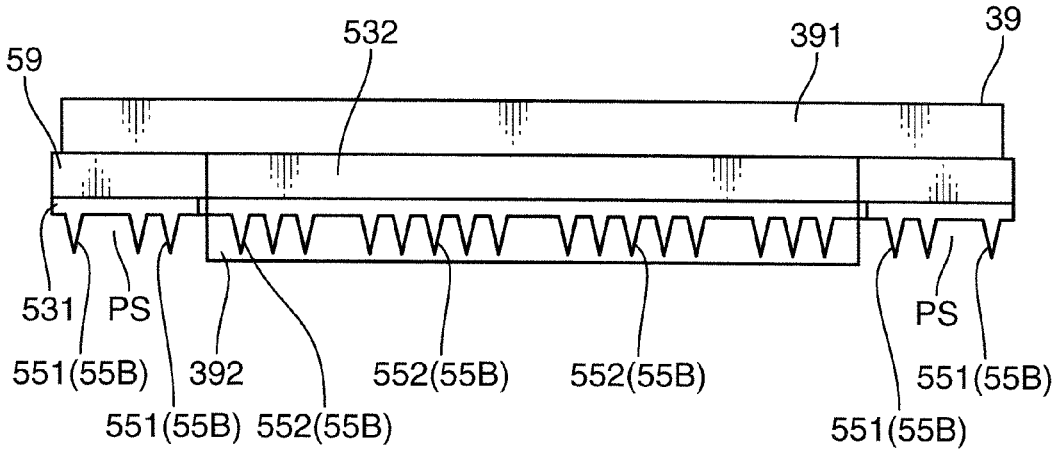
FIG. 16 is a schematic plan view of the first separation electrode body, the second separation electrode body and the insulating plate arranged on a partition included in the separating unit shown in FIG. 13.

FIG. 16 is a schematic plan view showing the partition 39 and an assembly of the first separation electrode body 531, the insulating plate 59 and the second separation electrode body 532. In FIG. 16, the assembly of the first separation electrode body 531, the insulating plate 59 and the second separation electrode body 532 is attached to the partition 39. A positional relationship between the partition 39 and the needle electrodes 55B is described with reference to FIGS. 1, 13, 15 and 16.

The partition 39 includes an elongated portion 391 and a projecting portion 392 similarly to the first embodiment. Further, spaces PS for allowing flow of a transfer current are formed adjacent to the projecting portion 392.

The projecting portion 392 overlaps the second needle electrodes 552 corresponding to the print area PA. The spaces PS overlap the first needle electrodes 551 corresponding to the margin areas MA.

As shown in FIG. 13, the projecting portion 392 is larger than the second needle electrodes 552 and projects from the electrode housing 51 toward an intermediate transfer belt 14. Accordingly, like the first embodiment, the partition 39 suppresses the flow of the transfer current to the second needle electrodes 552. On the other hand, the transfer current from the secondary transfer roller 35 flows to the first needle electrodes 551 through the spaces PS similarly to the first embodiment.

(Operation of Second Application Circuit)

The operation of the second application circuit 38B is described with reference to FIGS. 1, 13 and 15.

As described above, when a user uses an operation panel 4 to instruct the copier 1B to perform duplex printing, a toner image is secondarily transferred to a first surface FS of a sheet S. At this time, a part of the transfer current flows from the secondary transfer roller 35 to the first needle electrodes 551. In this way, the transfer voltage decreases as described in the context of the first and second embodiments. When the toner image is secondarily transferred to the first surface FS of the sheet S, the control circuit 383 executes a control to substantially match a magnitude of the first separation current with that of the second separation current. As a result, the separation current is uniformly supplied to the first separation electrode body 531 (first needle electrodes 551) and the second separation electrode body 532 (second needle electrodes 552).

Thereafter, the control circuit 383 sets an absolute value of the first separation current to be larger than that of the second separation current when a toner image is secondarily transferred to a second surface SS of the sheet S. As a result, the transfer current flowing to the first needle electrodes 551 becomes higher than when the toner image is secondarily transferred to the first surface FS. Generally, a resistance value of the sheet S is increased by the secondary transfer of the toner image to the first surface FS of the sheet S. Thus, an increase in the transfer current to the first needle electrodes 551 when the toner image is secondarily transferred to the second surface SS is preferable in order to suppress incomplete transfer of the toner image.

(Experiment)

Figure 17:
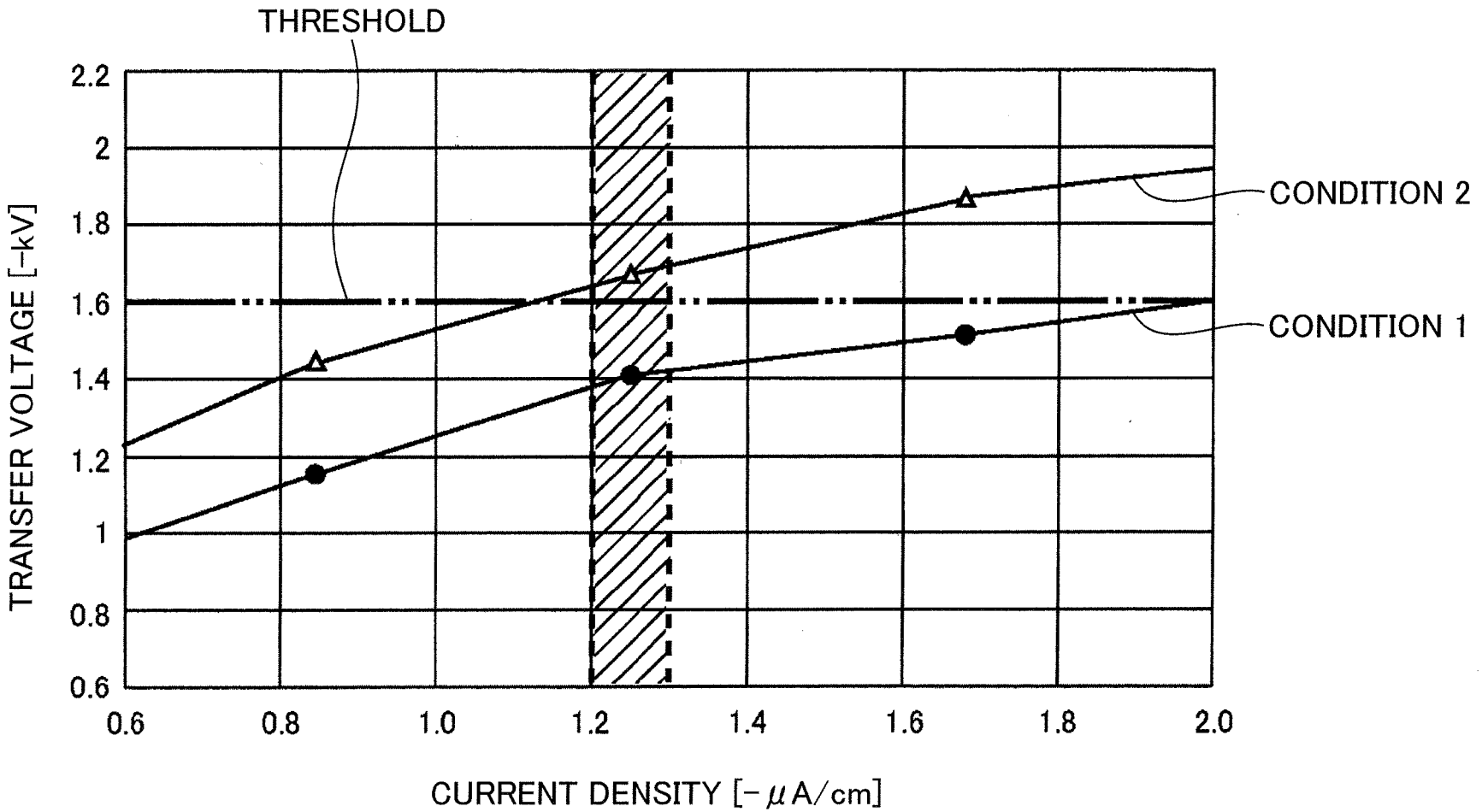
FIG. 17 is a graph schematically showing a relationship between a current density and a transfer voltage.

FIG. 17 is a graph showing a relationship between the current density and the transfer voltage. Effects of the third embodiment are described with reference to FIGS. 15 and 17.

A condition 1 shown in FIG. 17 is a curve representing a relationship between the current density and the transfer voltage at the time of using the separating unit 37B described in the context of the third embodiment. A condition 2 shown in FIG. 17 is a curve representing a relationship between the current density and the transfer voltage at the time of replacing the partition 39 of the separating unit 37B with the partition T described in the context of the first embodiment.

Sheets S which have toner images transferred to first surfaces FS thereof, respectively, were prepared. The sheets S were 297 mm in width (A4 size). A range of the current density suitable for the secondary transfer in a passage area was from −1.2 μA/cm to −1.3 μA/cm. Through the conditions 1 and 2, the current density in the passage area was set at −1.26 μA/cm.

On the condition 2, the transfer current was set at −37.5 μA to achieve a current density of −1.26 μA/cm. At this time, the transfer voltage was −1.67 kV. As a result of observing a toner image on the sheet S after the experiment, incomplete transfer of the toner image was confirmed.

A transfer current of −4.2 μA flowed from the secondary transfer roller 35 to the first needle electrodes 551 under the condition 1. The transfer current was set at −41.7 μA for compensation of the transfer current of −4.2 μA to the first needle electrodes 551. At this time, the transfer voltage was −1.41 kV. Thus, a smaller absolute value of the transfer voltage was obtained under the condition 1 than under the condition 2. As a result of observing a toner image transferred to the second surface SS, no incomplete transfer of the toner image was confirmed.

A flow of the transfer current from the secondary transfer roller 35 to the first needle electrodes 551 means interference of the transfer voltage with the separation voltage at both ends of the secondary transfer roller 35. As a result of observing the toner image on the second surface SS of the sheet S obtained when using the partition 39, however, no incomplete transfer resulting from the interference between the transfer voltage and the separation voltage was confirmed.

Further, a relationship between the absolute value of the transfer voltage and the incomplete transfer of the toner image was confirmed. A thicker chain double-dashed line of FIG. 17 indicates a threshold value for the absolute value of the transfer voltage. When the absolute value of the transfer voltage exceeds 1.6 kV, the incomplete transfer of the toner image occurs. When the absolute value of the transfer voltage falls below 1.6 kV, the incomplete transfer of the toner image does not occur.

In the copier 1B according to the third embodiment, the absolute value of the transfer voltage sufficiently below the threshold value was achieved.

In this embodiment, the first separation current to the first needle electrodes 551 is higher than the second separation current to the second needle electrodes 552. Since the higher first separation current flows to the first needle electrodes 551 closer to the lateral edges SE of the sheet S, electrical neutralization in areas along the lateral edges SE of the sheet S is more likely to occur than in a central part of the sheet S. As a result, the lateral edges SE of the sheet S are more likely to be separated from the intermediate transfer belt 14 earlier than the central part of the sheet S.

A ground plate is generally arranged in the discharge conveyance path 305 for conveying the sheet S after the secondary transfer. Typically, the ground plate is so arranged as to face a surface of the sheet opposite to the one to which the toner image is secondarily transferred. After the lateral edges SE of the sheet S are separated from the intermediate transfer belt 14 earlier than the central part of the sheet S as described above, the sheet S is conveyed along the ground plate. In this way, the sheet S is smoothly conveyed to the fixing device 40. As a result, it is unlikely that the sheet S creases.

In this embodiment, the absolute value of the first separation current supplied to a pair of groups of the first needle electrodes 551 corresponding to the paired margin areas MA extending along the both lateral edges SE of the sheet S is set to be larger than the absolute value of the second separation current. Alternatively, the absolute value of the first separation current supplied to the first needle electrodes 551 corresponding to one of the paired margin areas MA may be set to be larger than that of the second separation current. It should be noted that the first needle electrodes 551 receiving a larger absolute value of the first separation current are electrically insulated from another group of the first needle electrodes 551.

In this embodiment, the first separation current is increased when the toner image is secondarily transferred to the second surface SS of the sheet S. Alternatively, the first separation current may be increased when the toner image is secondarily transferred to the first surface FS of the sheet S. Further alternatively, the first separation current may be set to be higher than the second separation current not only at the time of duplex printing but also at the time of simplex printing. Further alternatively, the first separation current may be increased when an ambient temperature and/or an ambient humidity is lower.

In the above embodiments, the spaces PS for allowing the transfer current to flow to the first needle electrodes 551, 551A are formed in correspondence with the paired margin areas MA corresponding to the both lateral edges SE of the sheet S. Alternatively, the space PS may be provided in correspondence with one of the margin areas MA.

In the above embodiments, the partition 39 is longer than the separation electrode bodies 53, 53A and 53B. On the other hand, the projecting portion 392 of the partition 39 is shorter than the separation electrode bodies 53, 53A and 53B. This causes the spaces PS for allowing the transfer current to flow to the first needle electrodes 551, 551A to be formed. Alternatively, the partition 39 may be formed to be shorter than the separation electrode bodies 53, 53A and 53B. It should be noted that a part of the partition 39 projecting between the secondary transfer roller 35 and the separation electrode body 53, 53A or 53B is preferably longer than the width of the print area PA.

In the above embodiments, the circumferential surfaces of the photoconductive drums are made of amorphous silicon. Alternatively, the circumferential surfaces of the photoconductive drums may be made of organic photoconductor (OPC).

In the above embodiments, the partition 39 is mounted on the base plate 511 of the electrode housing 51. Alternatively, the partition 39 may be formed integrally to the base plate 511.

In the above embodiments, the image forming apparatus is of the tandem type configured to perform color printing. Alternatively, the image forming apparatus may perform only monochrome printing. Thus, a principle described in the context of the aforementioned embodiments is also applied to a technology for directly transferring a toner image to a sheet S from the photoconductive drum 21. The transfer current flowing to the first needle electrodes 551, 551A suppresses damage of the photoconductive drum 21. In this case, the photoconductive drum 21 is exemplified as an image bearing member.

An image forming apparatus according to one aspect of the above embodiments comprises an image bearing member configured to bear a toner image; a transfer element configured to transfer the toner image from the image bearing member to a sheet; a first application element configured to apply a transfer voltage to the transfer element in order to transfer the toner image from the image bearing member to the sheet; a separator configured to separate the sheet after the transfer of the toner image thereon from the image bearing member; and a partition configured to project between the transfer element and the separator, wherein the separator includes a separation electrode configured to discharge a current to separate the sheet after the transfer of the toner image thereon from the image bearing member; the separation electrode includes first and second separation electrodes aligned along the transfer element; and the partition allows a current to flow from the transfer element to the first separation electrode while the partition suppresses a current flowing from the transfer element to the second separation electrode.

According to the above configuration, when the first application element applies the transfer voltage to the transfer element, the transfer element transfers the toner image on the image bearing member to the sheet. The separation electrode discharges the electrical current to separate the sheet after the transfer of the toner image thereon from the image bearing member. The partition projects between the transfer element and the separation electrode. The separation electrode includes the first and second separation electrodes aligned along the transfer element. The transfer voltage is reduced since the partition allows the current to flow from the transfer element to the first separation electrode while suppressing the current flowing from the transfer element to the second separation electrode.

In the above configuration, it is preferable that a conveying element configured to convey the sheet to a nip portion formed between the image bearing member and the transfer element is further provided; that the sheet includes a lateral edge extending in a conveying direction defined by the conveying element; and that the first separation electrode is closer to the lateral edge than the second separation electrode.

According to the above configuration, the conveying element conveys the sheet to the nip portion formed between the image bearing member and the transfer element. The sheet includes the lateral edge extending along the conveying direction defined by the conveying element. The first separation electrode is closer to the lateral edge than the second separation electrode. Since the current flows from the transfer element to the first separation electrode near the lateral edge of the sheet where a toner image is less likely to be formed, the toner image transferred to the sheet is less likely to degrade.

In the above configuration, it is preferable that the sheet includes a first area extending along the lateral edge and a second area adjacent to the first area; that the transfer element does not transfer the toner image to the first area while transferring the toner image to the second area; and that the first separation electrode corresponds to the first area.

According to the above configuration, the sheet includes the first area extending along the lateral edge and the second area adjacent to the first area. The transfer element does not transfer the toner image to the first area while transferring the toner image to the second area. Since the current flows from the transfer element to the first separation electrode provided in correspondence with the first area, the toner image transferred to the sheet is less likely to degrade.

In the above configuration, it is preferable that the second separation electrode projects toward the image bearing member; and that the first separation electrode projects toward the transfer element.

According to the above configuration, the second separation electrode projecting toward the image bearing member facilitates to separate the sheet from the image bearing member. The first separation electrode projecting toward the transfer element facilitates to flow the current from the transfer element to the first separation electrode. As a result, the transfer voltage is likely to decrease.

In the above configuration, it is preferable that the separator includes a second application element configured to apply a separation voltage for discharging the electrical current from the separation electrode, to the separation electrode in order to supply a separation current; and that the second application element supplies a first separation current to the first separation electrode and supplies a second separation current different from the first separation current in magnitude to the second separation electrode.

According to the above configuration, the separator includes the second application element configured to apply the separation voltage to the separation electrode in order to discharge the electrical current from the separation electrode and to supply the separation current. The second application element supplying the first separation current to the first separation electrode and supplying the second separation current different from the first separation current in magnitude to the second separation electrode facilitates to flow the current from the transfer element to the first separation electrode. As a result, The transfer voltage is likely to decrease.

In the above configuration, it is preferable that the toner image includes a first toner image and a second toner image formed after the first toner image; that the sheet includes a first surface to which the first toner image is to be transferred and a second surface to which the second toner image is to be transferred; that the second application element uniformly supplies the separation current to the first and second separation electrodes when the transfer element transfers the first toner image; that the second application element supplies the first and second separation currents to the first and second separation electrodes, respectively, when the transfer element transfers the second toner image to the second surface; and that an absolute value of the first separation current is larger than that of the second separation current.

According to the above configuration, the first toner image is transferred to the first surface of the sheet. The second toner image formed after the first toner image is transferred to the second surface opposite to the first surface. The second application element uniformly supplies the separation current to the first and second separation electrodes when the transfer element transfers the first toner image. When the transfer element transfers the second toner image to the second surface, the second application element supplies the first and second separation currents to the first and second separation electrodes, respectively. The absolute value of the first separation current larger than that of the second separation current facilitates to flow the current from the transfer element to the first separation electrode. As a result, the transfer voltage is further likely to decrease.

In the above configuration, the image bearing member preferably includes a photoconductor made of amorphous silicon.

According to the above configuration, incomplete transfer is preferably less likely to occur even if the photoconductor made of amorphous silicon is used.

This application is based on Japanese Patent application serial Nos. 2009-250501 and 2009-250502 filed in Japan Patent Office on Oct. 30, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus configured to form a toner image on a sheet, comprising:

an image bearing member configured to bear the toner image;

a transfer element configured to transfer the toner image from the image bearing member to the sheet;

a first application element configured to apply a transfer voltage to the transfer element in order to transfer the toner image from the image bearing member to the sheet;

a separator configured to separate the sheet after transfer of the toner image thereon from the image bearing member, the separator including a separation electrode configured to discharge an electrical current to separate the sheet after the transfer of the toner image thereon from the image bearing member and the separation electrode including first and second separation electrodes aligned along the transfer element; and a partition configured to project between the transfer element and the separator so as to allow a current to flow from the transfer element to the first separation electrode while the partition suppresses a current flowing from the transfer element to the second separation electrode.

2. An image forming apparatus according to claim 1, further comprising a conveying element configured to convey the sheet to a nip portion formed between the image bearing member and the transfer element, wherein:

the sheet includes a lateral edge extending in a conveying direction defined by the conveying element; and the first separation electrode is closer to the lateral edge than the second separation electrode.

3. An image forming apparatus according to claim 2, wherein:

the sheet includes a first area extending along the lateral edge and a second area adjacent to the first area;

the transfer element does not transfer the toner image to the first area while transferring the toner image to the second area; and the first separation electrode corresponds to the first area.

4. An image forming apparatus according to claim 1, wherein:

the second separation electrode projects toward the image bearing member; and the first separation electrode projects toward the transfer element.

5. An image forming apparatus according to claim 1, wherein:

the separator includes a second application element configured to apply a separation voltage to the separation electrode in order to discharge the electrical current from the separation electrode and to supply a separation current; and the second application element supplies a first separation current to the first separation electrode and supplies a second separation current different from the first separation current in magnitude to the second separation electrode.

6. An image forming apparatus according to claim 5, wherein:

the toner image includes a first toner image and a second toner image formed after the first toner image;

the sheet includes a first surface to which the first toner image is to be transferred and a second surface to which the second toner image is to be transferred;

the second application element uniformly supplies the separation current to the first and second separation electrodes when the transfer element transfers the first toner image;

the second application element supplies the first and second separation currents to the first and second separation electrodes, respectively, when the transfer element transfers the second toner image to the second surface; and an absolute value of the first separation current is larger than that of the second separation current.

7. An image forming apparatus according to claim 1, wherein the image bearing member includes a photoconductor made of amorphous silicon.

* * * * *